US011437006B2

(12) United States Patent
Liu et al.

(10) Patent No.: US 11,437,006 B2
(45) Date of Patent: Sep. 6, 2022

(54) SYSTEMS AND METHODS FOR MUSIC SIMULATION VIA MOTION SENSING

(71) Applicant: SUNLAND INFORMATION TECHNOLOGY CO., LTD., Shanghai (CN)

(72) Inventors: Xiaolu Liu, Shanghai (CN); Bin Yan, Shanghai (CN); Min Zhou, Shanghai (CN); Yuanheng Tao, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 213 days.

(21) Appl. No.: 16/858,814

(22) Filed: Apr. 27, 2020

(65) Prior Publication Data

US 2020/0258490 A1 Aug. 13, 2020

Related U.S. Application Data

(63) Continuation of application No. PCT/CN2019/086832, filed on May 14, 2019.

(30) Foreign Application Priority Data

Jun. 14, 2018 (CN) ..... 201810613996.1

(51) Int. Cl.
*G10H 5/00* (2006.01)
*G10H 1/00* (2006.01)

(52) U.S. Cl.
CPC ..... *G10H 5/007* (2013.01); *G10H 1/0025* (2013.01); *G10H 1/0033* (2013.01)

(58) Field of Classification Search
CPC ..... G10H 5/007; G10H 1/0025; G10H 1/0033
(Continued)

(56) References Cited

U.S. PATENT DOCUMENTS 5,512,703 A * 4/1996 Usa ..... G10H 5/007 84/600
7,723,604 B2 * 5/2010 Bang ..... G10H 1/0041 84/626

(Continued)

FOREIGN PATENT DOCUMENTS

CN 1389850 A 1/2003
CN 101504832 A * 8/2009

(Continued)

OTHER PUBLICATIONS

International Search Report in PCT/CN2019/086832 dated Aug. 20, 2019, 5 pages.

(Continued)

*Primary Examiner* — Christina M Schreiber
(74) *Attorney, Agent, or Firm* — Metis IP LLC

(57) ABSTRACT

The present disclosure relates to systems, methods, and devices for music simulation. The methods may include determining one or more simulation actions based on data associated with one or more simulation actions acquired by at least one sensor. The methods may further include determining, based on at least one of the one or more simulation actions and a mapping relationship between simulation actions and corresponding musical instruments, a simulation musical instrument that matches with the one or more simulation actions. The methods may further include determining, based on the one or more simulation actions, one or more first features associated with the simulation musical instrument. The methods may further include playing music based on the one or more first features.

17 Claims, 11 Drawing Sheets

(58) Field of Classification Search
USPC ..... 84/622
See application file for complete search history.

(56) References Cited

U.S. PATENT DOCUMENTS

| | | | | |
|---|---|---|---|---|
| 8,445,769 | B2 * | 5/2013 | Takahashi | G10H 1/0008 84/723 |
| 8,721,441 | B1 * | 5/2014 | Chen | A63F 13/843 463/35 |
| 10,220,303 | B1 * | 3/2019 | Schmidt | A63F 13/42 |
| 2005/0204906 | A1 * | 9/2005 | Lengeling | G10H 1/346 84/744 |
| 2006/0065108 | A1 * | 3/2006 | Kergomard | G10H 1/16 84/659 |
| 2011/0086705 | A1 * | 4/2011 | Chiu | A63F 13/44 463/43 |
| 2012/0214587 | A1 * | 8/2012 | Segal | A63F 13/814 463/30 |
| 2012/0323521 | A1 * | 12/2012 | De Foras | G06F 3/0346 702/141 |
| 2014/0298975 | A1 * | 10/2014 | Clark | G10H 1/0025 84/626 |
| 2014/0318347 | A1 * | 10/2014 | Wang | G06F 3/041 84/609 |
| 2015/0185850 | A1 * | 7/2015 | Guilak | G06F 3/017 345/156 |
| 2015/0233779 | A1 * | 8/2015 | Chen | G01P 15/00 702/139 |
| 2017/0303853 | A1 * | 10/2017 | McMillen | A61B 5/6843 |
| 2020/0258490 | A1 * | 8/2020 | Liu | G10H 1/0008 |

FOREIGN PATENT DOCUMENTS

| | | | | |
|---|---|---|---|---|
| CN | 101504832 | A | | 8/2009 |
| CN | 102478959 | A | | 5/2012 |
| CN | 103235642 | A | * | 8/2013 |
| CN | 103235642 | A | | 8/2013 |
| CN | 104598016 | A | * | 5/2015 |
| CN | 104598016 | A | | 5/2015 |
| CN | 105389013 | A | | 3/2016 |
| CN | 105867656 | A | | 8/2016 |
| CN | 105931627 | A | * | 9/2016 |
| CN | 105931627 | A | | 9/2016 |
| CN | 106652656 | A | * | 5/2017 |
| CN | 106652656 | A | | 5/2017 |
| CN | 110231870 | A | * | 9/2019 |
| WO | 2019237871 | A1 | | 12/2019 |

OTHER PUBLICATIONS

Written Opinion in PCT/CN2019/086832 dated Aug. 20, 2019, 5 pages.
First Office Action in Chinese Application No. 201810613996.1 dated Feb. 28, 2020, 27 pages.

* cited by examiner

SYSTEMS AND METHODS FOR MUSIC SIMULATION VIA MOTION SENSING

CROSS-REFERENCE TO RELATED APPLICATIONS

This application is a continuation application of International Application No. PCT/CN2019/086832, field on May 14, 2019, which claims priority of Chinese Application No. 201810613996.1, filed on Jun. 14, 2018, the entire contents of each of which are hereby incorporated by reference.

TECHNICAL FIELD

This disclosure generally relates to music instrument technology, and more particularly, to systems and methods for music simulation via motion sensing.

BACKGROUND

Musical instruments, such as the piano, the violin, and the guitar, are popular around the world. For example, the piano is a musical instrument played using a keyboard. The piano may include pedals, tuning nails, hammers, dampers, a soundboard, keys (e.g., white keys and black keys), etc. Some musical instruments, such as the piano, have a relatively large volume and are too heavy to be carried around by a user. This may make it inconvenient for people who would like to play these musical instruments and enjoy the music at various places, for example, in the house of their friends, in a campsite, or the like. In recent years, with the development of smart terminals, a user may touch the screen of a smart phone to simulate playing a musical instrument. But this experience is much different from the experience of playing real musical instruments due to different actions (e.g., fingerings) for playing the music instrument. Therefore, it is desirable to provide systems and methods for music simulation via motion sensing in order to improve the experience for music simulation of the user.

SUMMARY

According to an aspect of the present disclosure, a method for music simulation via motion sensing is provided. The method may be implemented on a motion sensing device. The method may include acquiring one or more simulation actions of a user simulating playing a specific musical instrument. The method may further include determining, based on the one or more simulation actions of the user, a simulation musical instrument that matches with the one or more simulation actions of the user from a predetermined dataset including relationships between actions and musical instruments. The method may further include playing music based on the simulation musical instrument.

In some embodiments, the playing music based on the simulation musical instrument may include acquiring one or more current simulation actions of the user simulating playing the specific musical instrument in real-time, determining one or more pronunciation intensities of the simulation musical instrument based on one or more amplitudes of the one or more current simulation actions, and determining a music rhythm of the simulation musical instrument based on a rhythm of the one or more current simulation actions.

In some embodiments, the method may further include transmitting the music played based on the simulation musical instrument to a musical instrument terminal, wherein the musical instrument terminal is configured to perform a tutti on multiple pieces of music played based on a plurality of the simulation musical instruments.

According to another aspect of the present disclosure, a method for music simulation via motion sensing is provided. The method may be implemented on a motion sensing device. The method may include acquiring one or more simulation actions of a user simulating playing a specific musical instrument and transmitting the acquired one or more simulation actions of the user to a musical instrument terminal. The musical instrument terminal may be configured to determine a simulation musical instrument that matches with the one or more simulation actions of the user simulating playing the specific musical instrument. The method may further include playing music based on the simulation musical instrument.

According to yet another aspect of the present disclosure, a motion sensing device is provided. The motion sensing device may include a processor and a storage. The storage may store program instructions, the processor may execute the program instructions to implement the method for music simulation via motion sensing described above.

In some embodiments, the motion sensing device may determine the one or more simulation actions of the user simulating playing the specific musical instrument based on a motion distance and a motion direction generated by the user's moving the motion sensing device acquired by an acceleration sensor.

According to yet another aspect of the present disclosure, a method for music simulation via motion sensing is provided. The method may be implemented on a musical instrument terminal. The method may include receiving one or more simulation actions of a user simulating playing a specific musical instrument acquired by a motion sensing device. The method may further include determining, based on the one or more simulation actions of the user, a simulation musical instrument that matches with the one or more simulation actions of the user from a predetermined dataset including relationships between actions and musical instruments. The method may further include playing music based on the simulation musical instrument.

In some embodiments, the playing music based on the simulation musical instrument may include receiving in real-time the one or more simulation actions of the user, determining one or more pronunciation intensities of the simulation musical instrument based on one or more amplitudes of the one or more simulation actions, and determining a music rhythm of the simulation musical instrument based on a rhythm of the one or more simulation actions.

In some embodiments, the method may include acquiring at least two pieces of music played based on at least two of the simulation musical instruments. The method may further include performing a tutti on the at least two pieces of music.

According to still another aspect of the present disclosure, a method for music simulation via motion sensing is provided. The method may be implemented on a musical instrument terminal. The method may include receiving at least two pieces of music played by simulating playing at least two musical instruments from at least two motion sensing devices. The method may further include performing a tutti on the received at least two pieces of music.

According to yet another aspect of the present disclosure, a musical instrument terminal is provided. The musical instrument terminal may include a processor and a storage. The storage may store program instructions. The processor may execute the program instructions to implement the method for music simulation described above.

According to still another aspect of the present disclosure, a system for music simulation is provided. The system may include at least one storage device storing a set of instructions, at least one sensor configured to obtain data associated with one or more simulation actions of a user simulating playing a specific musical instrument, and at least one processor in communication with the at least one storage device. When executing the set of instructions, the at least one processor may be directed to cause the system to determine the one or more simulation actions based on the data associated with the one or more simulation actions acquired by the at least one sensor. The at least one processor may be further directed to cause the system to determine, based on at least one of the one or more simulation actions and a mapping relationship between simulation actions and corresponding musical instruments, a simulation musical instrument that matches with the one or more simulation actions. The at least one processor may be further directed to cause the system to determine, based on the one or more simulation actions, one or more first features associated with the simulation musical instrument. The at least one processor may be further directed to cause the system to play music based on the one or more first features.

In some embodiments, the at least one sensor may include at least one of a camera or an accelerometer.

In some embodiments, the data may include movement data generated by the user moving the at least one sensor, and to determine the one or more simulation actions based on the data, the at least one processor may be directed to cause the system to determine, based on the movement data of the user, a displacement of the at least one sensor. The at least one processor may be further directed to cause the system to determine, based on the displacement of the at least one sensor, the one or more simulation actions.

In some embodiments, the data may include image data of the user moving the at least one sensor, and to determine the one or more simulation actions based on the data, the at least one processor may be directed to cause the system to identify the one or more simulation actions from the image data of the user.

In some embodiments, to determine, based on the one or more simulation actions, the one or more first features, the at least one processor may be directed to cause the system to determine one or more second features associated with the one or more simulation actions and determine, based on the one or more second features associated with the one or more simulation actions, the one or more first features.

In some embodiments, the one or more first features may include at least one of a pronunciation intensity of the simulation musical instrument, a music rhythm of the simulation musical instrument, or a pitch of the simulation musical instrument.

In some embodiments, the one or more second features include at least one of one or more amplitudes of the one or more simulation actions or a rhythm of the one or more simulation actions.

In some embodiments, to determine, based on the one or more second features, the one or more first features, the at least one processor is directed to cause the system to determine the one or more pronunciation intensities of the simulation musical instrument based on the one or more amplitudes of the one or more simulation actions. The at least one processor may be further directed to cause the system to determine the music rhythm of the simulation musical instrument based on the rhythm of the one or more simulation actions.

In some embodiments, the at least one processor may be further directed to cause the system to perform a tutti on at least two pieces of music associated with at least two of the simulation musical instruments.

According to yet another aspect of the present disclosure, a method for music simulation is provided. The method may be implemented on a computing device having at least one processor and at least one non-transitory storage medium. The method may include determining one or more simulation actions based on data associated with one or more simulation actions acquired by at least one sensor. The method may further include determining, based on at least one of the one or more simulation actions and a mapping relationship between simulation actions and corresponding musical instruments, a simulation musical instrument that matches with the one or more simulation actions. The method may further include determining, based on the one or more simulation actions, one or more first features associated with the simulation musical instrument. The method may further include playing music based on the one or more first features.

According to still another aspect of the present disclosure, a non-transitory computer readable medium is provided. The method may include a set of instructions for music simulation. When executed by at least one processor, the set of instructions may direct the at least one processor to effectuate a method. The method may include determining one or more simulation actions based on data associated with one or more simulation actions acquired by at least one sensor. The method may further include determining, based on at least one of the one or more simulation actions and a mapping relationship between simulation actions and corresponding musical instruments, a simulation musical instrument that matches with the one or more simulation actions. The method may further include determining, based on the one or more simulation actions, one or more first features associated with the simulation musical instrument. The method may further include playing music based on the one or more first features.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities, and combinations set forth in the detailed examples discussed below.

BRIEF DESCRIPTION OF THE DRAWINGS

The present disclosure is further described in terms of embodiments. These embodiments are described in detail with reference to the drawings. The drawings are not to scale. These embodiments are non-limiting embodiments, in which like reference numerals represent similar structures throughout the several views of the drawings, and wherein.

DETAILED DESCRIPTION

Figure 1:
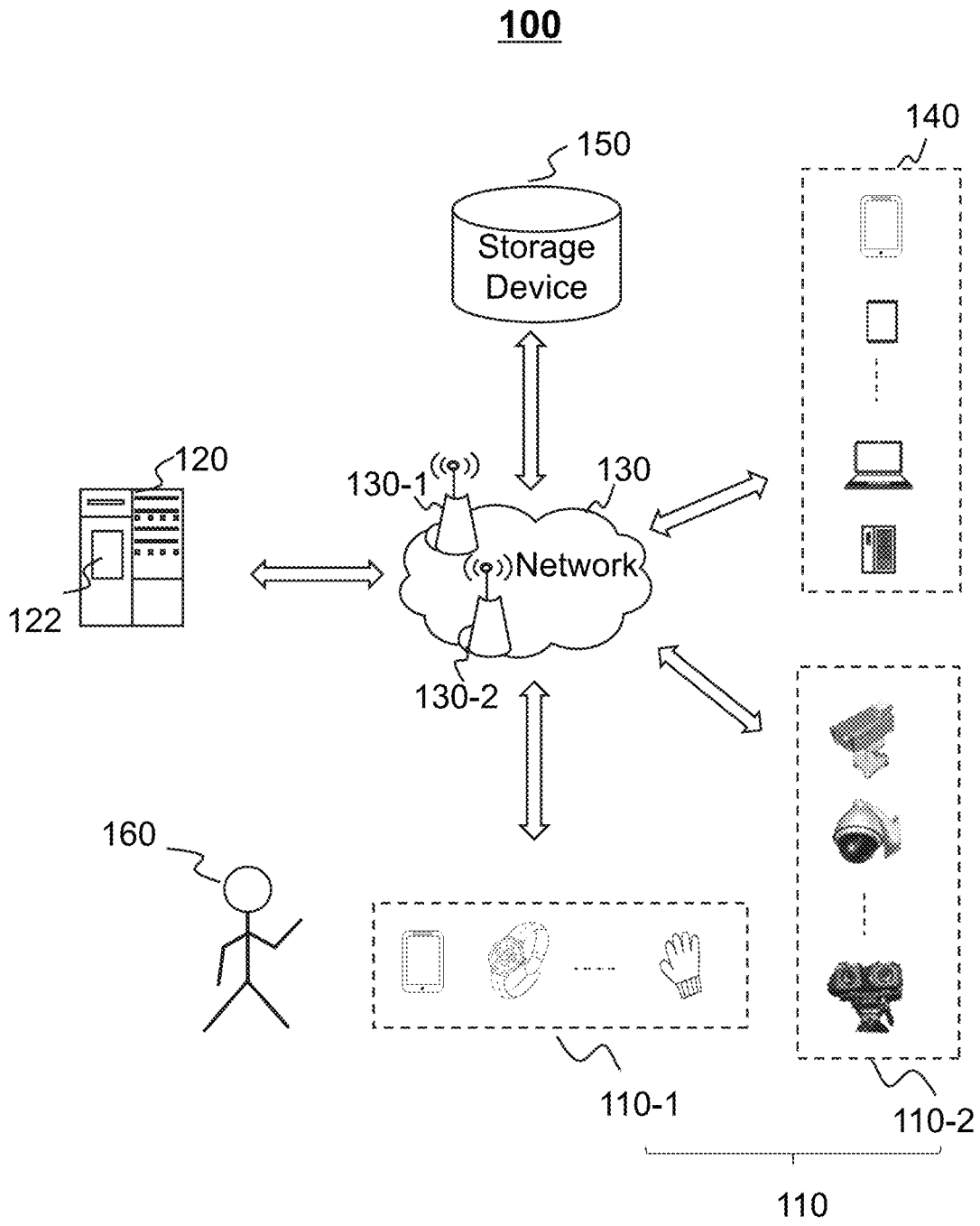
FIG. 1 is a schematic diagram illustrating a system for music simulation according to some embodiments of the present disclosure.

In order to illustrate the technical solutions related to the embodiments of the present disclosure, brief introduction of the drawings referred to in the description of the embodiments is provided below. Obviously, drawings described below are only some examples or embodiments of the present disclosure. Those having ordinary skills in the art, without further creative efforts, may apply the present disclosure to other similar scenarios according to these drawings. Unless stated otherwise or obvious from the context, the same reference numeral in the drawings refers to the same structure and operation.

As used in the disclosure and the appended claims, the singular forms "a," "an," and "the" include plural referents unless the content clearly dictates otherwise. It will be further understood that the terms "comprises," "comprising," "includes," and/or "including" when used in the disclosure, specify the presence of stated steps and elements, but do not preclude the presence or addition of one or more other steps and elements.

Some modules of the system may be referred to in various ways according to some embodiments of the present disclosure, however, any number of different modules may be used and operated in a user terminal and/or a server. These modules are intended to be illustrative, not intended to limit the scope of the present disclosure. Different modules may be used in different aspects of the system and method.

According to some embodiments of the present disclosure, flowcharts are used to illustrate the operations performed by the system. It is to be expressly understood, the operations above or below may or may not be implemented in order. Conversely, the operations may be performed in inverted order, or simultaneously. Besides, one or more other operations may be added to the flowcharts, or one or more operations may be omitted from the flowchart.

Technical solutions of the embodiments of the present disclosure be described with reference to the drawings as described below. It is obvious that the described embodiments are not exhaustive and are not limiting. Other embodiments obtained, based on the embodiments set forth in the present disclosure, by those with ordinary skill in the art without any creative works are within the scope of the present disclosure.

An aspect of the present disclosure is directed to systems and methods for music simulation. A user may perform one or more simulation actions to simulate playing a specific musical instrument, such as a piano, a guitar, a violin, etc. The systems and methods provided in the present disclosure may determine one or more pieces of music based on the one or more simulation actions of the user. At least one sensor may acquire data associated with the one or more simulation actions of the user. For example, the at least one sensor may include a camera, an accelerometer, a pressure sensor, etc. The one or more simulation actions may be determined based on the data associated with the one or more simulation actions. A simulation musical instrument that matches with the one or more simulation actions may be determined based on at least one of the one or more simulation actions and a mapping relationship between simulation actions and corresponding musical instruments. The one or more pieces of music may be determined based on one or more first features associated with the simulation musical instrument. For instance, the one or more first features may include at least one of a pronunciation intensity, a music rhythm, a pitch, a timbre, etc. The one or more first features may be determined based on one or more second features associated with the one or more simulation actions. The one or more second features may include but not limited to one or more amplitudes of the one or more simulation actions, a rhythm of the one or more simulation actions, or the like, or any combination thereof. Merely by way of example, the pronunciation intensity may be determined based on the one or more amplitudes of the one or more simulation actions. As another example, the music rhythm of the simulation musical instrument may be determined based on the rhythm of the one or more simulation actions.

FIG. 1 is a schematic diagram illustrating a system for music simulation according to some embodiments of the present disclosure. The system 100 shown in FIG. 1 may include one or more motion sensing devices 110 (e.g., a motion sensing device 110-1 and/or a motion sensing device 110-2), a server 120, a network 130, a terminal 140, and a storage device 150. A user 160 may perform one or more actions (also referred to as simulation actions) to simulate playing a specific musical instrument. The system 100 may be configured to determine and/or play a piece of music based on the one or more simulation actions associated with the user. The components in the system 100 may be connected in one or more of various ways. Merely by way of example, as illustrated in FIG. 1, the sensing device(s) 110 may be connected to the server 120 through the network 130. As another example, the storage device 150 may be connected with the server 120 through the network 130. As still a further example, the terminal 140 may be connected with the motion sensing device(s) 110 directly or through the network 130.

The motion sensing device(s) 110 may be configured to monitor the user 160. For example, the motion sensing device(s) 110 may catch and/or sense actions (or motion) of the user 160 to acquire data related to one or more actions of the user 160. The motion sensing device(s) 110 may include and/or installed with one or more sensors, such as a camera, an accelerometer, a gyroscope, a position sensor, a pressure sensor, a barometric pressure sensor, a bending sensor, an infrared sensor, or the like, or any combination thereof. In some embodiments, the motion sensing device(s) 110 may include a moveable sensing device (e.g., a motion sensing device 110-1) and an immobile sensing device (e.g., a motion sensing device 110-2). The motion sensing device 110-1 may move along with the user 160 when the user 160 is performing the one or more simulation actions. For instance, the motion sensing device 110-1 may include a mobile device (e.g., a smart phone, a tablet computer), a wearable device, a camera, etc. The wearable device may include but not limited to a smart watch, a smart bracelet, a smart glove, a smart ring, or the like, or any combination thereof. Merely by way of example, the user may wave a smart phone held in a hand to simulate waving a maraca. As another example, the user may wear a smart watch and wave his/or her hand(s) to simulate waving a maraca. In some embodiments, the user may flap, beat, or press the motion sensing device 110-1 to simulate playing a percussion instrument, such as a drum.

The motion sensing device 110-2 may be fixed on a support (e.g., a wall). In some embodiments, the motion sensing device 110-2 may include a camera. The camera may continuously acquire image data of the one or more simulation actions associated with the user. As used herein, the "image data" may refer to a static image, a series of image frames, a video, etc. In some embodiments, the motion sensing device 110-2 may include a spherical camera, a hemispherical camera, a rifle camera, etc. In some embodiments, the motion sensing device 110-2 may include a black-white camera, a color camera, an infrared camera, etc. In some embodiments, the motion sensing device 110-2 may include a digital camera, an analog camera, etc. In some embodiments, the motion sensing device 110-2 may include a monocular camera, a binocular camera, a multi-camera, etc. In some embodiments, the motion sensing device 110-2 may transmit the acquired image data to any component (e.g., the server 120, the terminal 140, and/or the storage device 150) of the system 100 via the network 130.

In some embodiments, the motion sensing device 110 may transmit the data associated with the one or more simulation actions of the user 160 to the server 120, the terminal 140, and/or the storage device 150. In some embodiments, the motion sensing device 110 may include one or more processors that perform the functions of the processing engine 122 described elsewhere in the present disclosure. For example, the motion sensing device 110 may determine the one or more simulation actions based on the data associated with one or more simulation actions of the user 160. As another example, the motion sensing device 110 may determine the simulation musical instrument based on the one or more simulation actions and determine the piece of music based on the one or more simulation actions. In some embodiments, the motion sensing device 110 may be implemented on the computing device 200 in FIG. 2 or the terminal device 300 in FIG. 3.

The server 120 may facilitate data processing for the system 100. In some embodiments, the server 120 may be a single server or a server group. The server group may be centralized, or distributed (e.g., server 120 may be a distributed system). In some embodiments, the server 120 may be local or remote. For example, the server 120 may access information and/or data from the motion sensing device 110, the terminal 140, and/or the storage device 150 via the network 130. As another example, the server 120 may be directly connected to motion sensing device 110, the terminal 140, and/or the storage device 150 to access the information and/or data. In some embodiments, the server 120 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof. In some embodiments, the server 120 may be implemented on a computing device 200 having one or more components illustrated in FIG. 2 in the present disclosure.

In some embodiments, the server 120 may include a processing engine 122. The processing engine 122 may process information and/or data to perform one or more functions described in the present disclosure. For example, the processing engine 122 may acquire data associated with one or more actions of the user 160 from the motion sensing device(s) 110. The processing engine 122 may determine one or more simulation actions for simulating playing a musical instrument based on the data associated with one or more actions and/or motions of the user 160. As another example, the processing engine 122 may determine a musical instrument simulated by the user 160 (also referred to as simulation musical instrument) that matches with the one or more simulation actions. The processing engine 122 may determine one or more features associated with the simulation musical instrument based on the one or more simulation actions and determine a piece of music based on the one or more features. As yet another example, the processing engine 122 may generate a tutti based on at least two pieces of music associated with simulation actions of at least two users 160.

In some embodiments, the processing engine 122 may include one or more processing engines (e.g., single-core processing engine(s) or multi-core processor(s)). Merely by way of example, the processing engine 122 may include one or more hardware processors, such as a central processing unit (CPU), an application-specific integrated circuit (ASIC), an application-specific instruction-set processor (ASIP), a graphics processing unit (GPU), a physics processing unit (PPU), a digital signal processor (DSP), a field-programmable gate array (FPGA), a programmable logic device (PLD), a controller, a microcontroller unit, a reduced instruction-set computer (RISC), a microprocessor, or the like, or any combination thereof.

The network 130 may facilitate the exchange of information and/or data. In some embodiments, one or more components in the system 100 (e.g., the server 120, the motion sensing device 110, the terminal 140, and the storage device 150) may send information and/or data to other component(s) in the system 100 via the network 130. For example, the motion sensing device(s) 110 may transmit the data associated with the one or more actions of the user 160 to the processing engine 122 via the network 130. As another example, the processing engine 122 may transmit the piece of music determined based on the one or more features to the terminal 140 and/or the storage device 150 via the network 130. In some embodiments, the network 130 may be any type of wired or wireless network, or a combination thereof. Merely by way of example, the network 130 may include a cable network, a wireline network, an optical fiber network, a telecommunications network, an intranet, the Internet, a local area network (LAN), a wide area network (WAN), a wireless local area network (WLAN), a metropolitan area network (MAN), a wide area network (WAN), a public telephone switched network (PSTN), a Bluetooth™ network, a ZigBee network, a near field communication (NFC) network, or the like, or any combination thereof. In some embodiments, the network 130 may include one or more network access points. For example, the network 130 may include wired or wireless network access points such as base stations and/or internet exchange points 130-1, 130-2, . . . , through which one or more components of the system 100 may be connected to the network 130 to exchange data and/or information.

The terminal 140 may include a mobile device, a tablet computer, a laptop computer, or the like, or any combination thereof. In some embodiments, the mobile device may include a smart home device, a wearable device, a mobile equipment, a virtual reality device, an augmented reality device, or the like, or any combination thereof. In some embodiments, the smart home device may include a smart lighting device, a control device of an intelligent electrical apparatus, a smart monitoring device, a smart television, a smart video camera, an interphone, or the like, or any combination thereof. In some embodiments, the wearable device may include a bracelet, footgear, glasses, a helmet, a watch, clothing, a backpack, a smart accessory, or the like, or any combination thereof. In some embodiments, the mobile equipment may include a mobile phone, a personal digital assistance (PDA), a gaming device, a navigation device, a point of sale (POS) device, a laptop, a desktop, or the like, or any combination thereof. In some embodiments, the virtual reality device and/or the augmented reality device may include a virtual reality helmet, a virtual reality glass, a virtual reality patch, an augmented reality helmet, augmented reality glasses, an augmented reality patch, or the like, or any combination thereof. For example, the virtual reality device and/or the augmented reality device may include a Google Glass™, a RiftCon™, a Fragments™, a Gear VR™, etc.

In some embodiments, the terminal 140 may be a user terminal that may send and/or receive information associated with music simulation. A user (e.g., the user 160) may view the information associated with music simulation and/or give an instruction via a user interface. The user interface may be in the form of an application for music simulation on the terminal 140. The user interface implemented on the terminal 140 may be configured to facilitate communication between the user and the processing engine 122. In some embodiments, the user may input a request for music simulation via the user interface implemented on the terminal 140. The terminal 140 may send the request for music simulation to the motion sensing device 110 for acquiring the data associated with the one or more simulation actions of the user 160. In some embodiments, the user interface may facilitate the presentation or display of information and/or data (e.g., a signal) relating to music simulation. For example, the information and/or data may include more than one simulation musical instrument determined based on the one or more simulation actions of the user 160. The user 160 may choose one from the more than one simulation musical instruments for music simulation. In some embodiments, the user 160 may send a request for performing a tutti based on at least two pieces of music via the user interface implemented on the terminal.

In some embodiments, the motion sensing device 110 may be integrated with the terminal 140. For example, a smart phone may include one or more sensors (e.g., a camera, an accelerometer) for acquiring the data associated with the one or more simulation actions of the user 160 and perform the functions of the processing engine 122, the terminal 140, and the motion sensing device 110 described as described elsewhere in the present disclosure, such as determining the one or more simulation actions based on the data associated with one or more simulation actions of the user 160, determining the simulation musical instrument based on the one or more simulation actions, and determining the piece of music based on the one or more simulation actions.

In some embodiments, the terminal 140 may be a musical instrument terminal. The musical instrument terminal may include a sound equipment, a smart musical instrument (e.g., a smart piano, a smart guitar, etc.), a mobile device (e.g., a smart phone), or the like. The musical instrument terminal may receive a piece of music and play the piece of music. In some embodiments, the musical instrument terminal may play a tutti determined based on at least two pieces of music associated with simulation actions of at least two users 160. In some embodiments, the musical instrument terminal may include one or more processors that perform at least one portion of functions of the processing engine 122 described elsewhere in the present disclosure. For example, the musical instrument terminal may receive data associated with the one or more simulation actions of the user 160 and determine the simulation musical instrument based on the data associated with the one or more simulation actions of the user 160. As another example, the musical instrument terminal may determine the piece of music based on the one or more simulation actions and the simulation musical instrument. In some embodiments, the musical instrument terminal may be integrated with the motion sensing device 110. In some embodiments, the musical instrument terminal may be implemented on the computing device 200 in FIG. 2 or the terminal device 300 in FIG. 3.

The storage device 150 may store data and/or instructions. In some embodiments, the storage device 150 may store data obtained from the motion sensing device 110, the terminal 140, and/or the processing engine 122. For example, the storage device 150 may store the data associated with one or more simulation actions of the user 160. As another example, the storage device 150 may store one or more pieces of music determined based on the one or more simulation actions of the user 160. In some embodiments, the storage device 150 may store data and/or instructions that the server 120 may execute or use to perform methods described in some embodiments of the present disclosure. For example, the storage device 150 may store instructions that the processing engine 122 may execute or use to determine a piece of music based on the one or more simulation actions of the user 160.

In some embodiments, the storage device 150 may include a mass storage, a removable storage, a volatile read-and-write memory, a read-only memory (ROM), or the like, or any combination thereof. For example, the mass storage may include a magnetic disk, an optical disk, a solid-state drive, etc. The removable storage may include a flash drive, a floppy disk, an optical disk, a memory card, a zip disk, a magnetic tape, etc. The volatile read-and-write memory may include a random access memory (RAM). The RAM may include a dynamic RAM (DRAM), a double date rate synchronous dynamic RAM (DDR SDRAM), a static RAM (SRAM), a thyrisor RAM (T-RAM), and a zero-capacitor RAM (Z-RAM), etc. The ROM may include a mask ROM (MROM), a programmable ROM (PROM), an erasable programmable ROM (EPROM), an electrically-erasable programmable ROM (EEPROM), a compact disk ROM (CD-ROM), and a digital versatile disk ROM, etc. In some embodiments, the storage device 150 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof.

In some embodiments, the storage device 150 may be connected to the network 130 to communicate with one or more components in the system 100 (e.g., the server 120, the motion sensing device 110, and/or the terminal 140). One or more components in the system 100 may access the data or instructions stored in the storage device 150 via the network 130. In some embodiments, the storage device 150 may be directly connected to or communicate with one or more components in the system 100 (e.g., the server 120, the motion sensing device 110, and/or the terminal 140). In some embodiments, the storage device 150 may be part of the server 120.

It should be noted that the system 100 is merely provided for the purposes of illustration, and is not intended to limit the scope of the present disclosure. For persons having ordinary skills in the art, multiple variations or modifications may be made under the teachings of the present disclosure. For example, the system 100 may further include a database, an information source, or the like. As another example, the system 100 may be implemented on other devices to realize similar or different functions. However, those variations and modifications do not depart from the scope of the present disclosure. In some embodiments, the processing engine 122 may be integrated into the motion sensing device 110 and/or the terminal 140.

Figure 2:
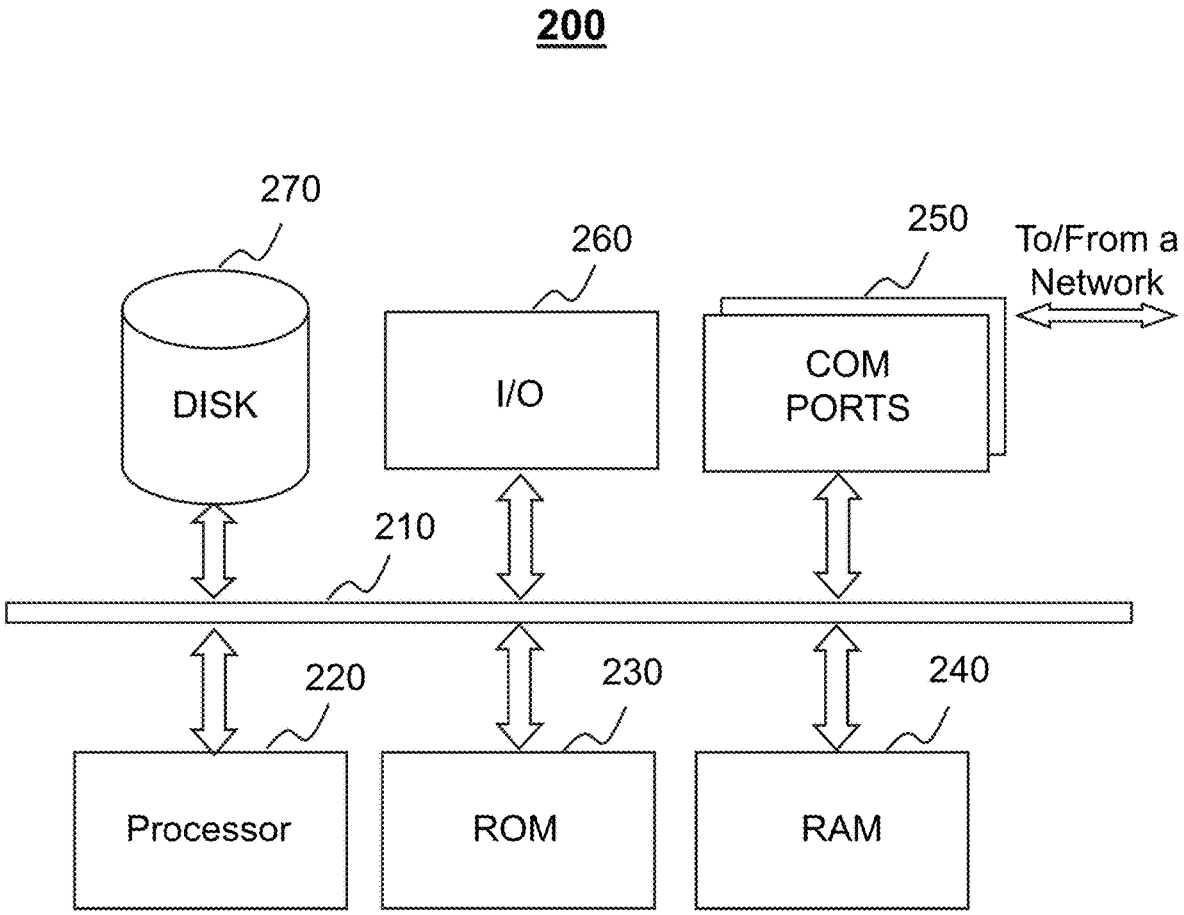
FIG. 2 is a schematic diagram illustrating components of a computing device according to some embodiments of the present disclosure.

FIG. 2 is a schematic diagram illustrating components of a computing device on which the server 120, the motion sensing device 110, and/or the terminal 140 may be implemented according to some embodiments of the present disclosure. The particular system may use a functional block diagram to explain the hardware platform containing one or more user interfaces. The computer may be a computer with general or specific functions. Both types of the computers may be configured to implement any particular system according to some embodiments of the present disclosure. Computing device 200 may be configured to implement any components that perform one or more functions disclosed in the present disclosure. For example, the computing device 200 may implement any component of the system 100 as described herein. In FIGS. 1-2, only one such computer device is shown purely for convenience purposes. One of ordinary skill in the art would understood at the time of filing of this application that the computer functions relating to intelligent musical instrument as described herein may be implemented in a distributed fashion on a number of similar platforms, to distribute the processing load.

The computing device 200, for example, may include COM ports 250 connected to and from a network connected thereto to facilitate data communications. The computing device 200 may also include a processor (e.g., the processor 220), in the form of one or more processors (e.g., logic circuits), for executing program instructions. For example, the processor may include interface circuits and processing circuits therein. The interface circuits may be configured to receive electronic signals from a bus 210, wherein the electronic signals encode structured data and/or instructions for the processing circuits to process. The processing circuits may conduct logic calculations, and then determine a conclusion, a result, and/or an instruction encoded as electronic signals. Then the interface circuits may send out the electronic signals from the processing circuits via the bus 210.

For example, the computing device may include the internal communication bus 210, program storage and data storage of different forms including, for example, a disk 270, and a read only memory (ROM) 230, or a random access memory (RAM) 240, for various data files to be processed and/or transmitted by the computing device. The computing device may also include program instructions stored in the ROM 230, RAM 240, and/or other type of non-transitory storage medium to be executed by the processor 220. The methods and/or processes of the present disclosure may be implemented as the program instructions. The computing device 200 also includes an I/O component 260, supporting input/output between the computer and other components. The computing device 200 may also receive programming and data via network communications.

Merely for illustration, only one CPU and/or processor is illustrated in FIG. 2. Multiple CPUs and/or processors are also contemplated; thus operations and/or steps performed by one CPU and/or processor as described in the present disclosure may also be jointly or separately performed by the multiple CPUs and/or processors. For example, if in the present disclosure the CPU and/or processor of the computing device 200 executes both operation A and operation B, it should be understood that operation A and operation B may also be performed by two different CPUs and/or processors jointly or separately in the computing device 200 (e.g., the first processor executes operation A and the second processor executes operation B, or the first and second processors jointly execute operation s A and B).

Figure 3:
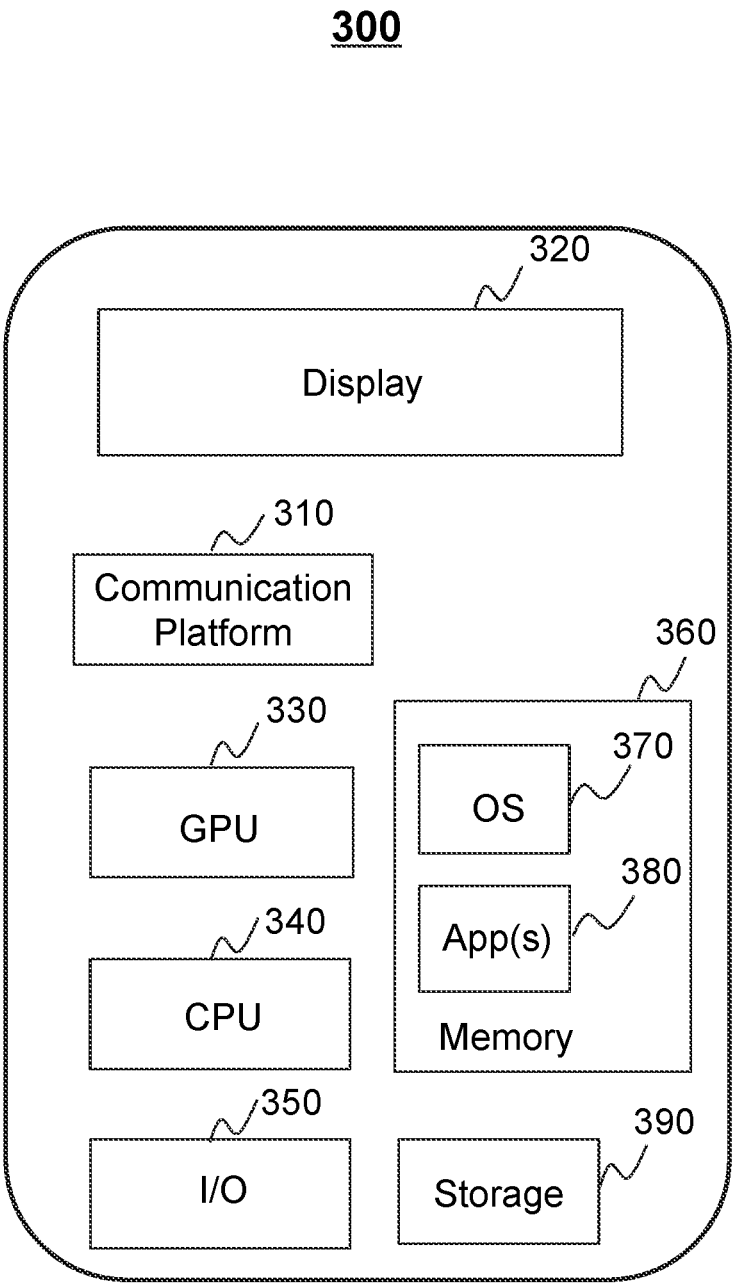
FIG. 3 is a schematic diagram illustrating hardware and/or software components of a user terminal according to some embodiments of the present disclosure.

FIG. 3 is a schematic diagram illustrating hardware and/or software components of a mobile device according to some embodiments of the present disclosure, on which the motion sensing device 110 may be implemented according to some embodiments of the present disclosure. As illustrated in FIG. 3, the terminal device 300 may include a communication platform 310, a display 320, a graphic processing unit (GPU) 330, a central processing unit (CPU) 340, an I/O 350, a memory 360, and storage 390. The CPU 340 may include interface circuits and processing circuits similar to the processor 220. In some embodiments, any other suitable component, including but not limited to a system bus or a controller (not shown), may also be included in the terminal device 300. In some embodiments, a mobile operating system 370 (e.g., iOS™, Android™, Windows Phone™, etc.) and one or more applications 380 may be loaded into the memory 360 from the storage 390 in order to be executed by the CPU 340. The applications 380 may include a browser or any other suitable mobile apps for receiving and rendering information from the system 100 on the terminal device 300. User interactions with the information stream may be achieved via the I/O 350 and provided to the processing engine 122 and/or other components of the system 100 via the network 130.

In order to implement various modules, units and their functions described above, a computer hardware platform may be used as hardware platforms of one or more elements (e.g., a component of the sever 110 described in FIG. 2). Since these hardware elements, operating systems, and program languages are common, it may be assumed that persons skilled in the art may be familiar with these techniques and they may be able to provide information required in the intelligent musical instrument system according to the techniques described in the present disclosure. A computer with a user interface may be used as a personal computer (PC), or other types of workstations or terminal devices. After being properly programmed, a computer with a user interface may be used as a server. It may be considered that those skilled in the art may also be familiar with such structures, programs, or general operations of this type of computer device. Thus, extra explanations are not described for the figures.

Figure 4:
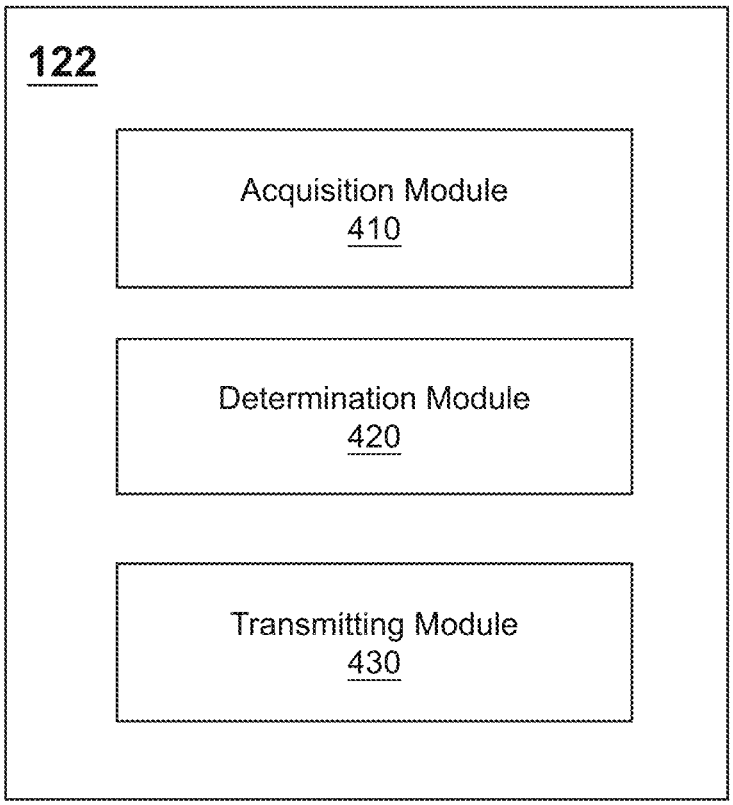
FIG. 4 is a block diagram illustrating a processing engine according to some embodiments of the present disclosure.

FIG. 4 is a schematic diagram illustrating a processing engine according to some embodiments of the present disclosure. In some embodiments, the processing engine 122 may be implemented on the motion sensing device(s) 110, the server 120, and/or the terminal 140 in the system 100 for music simulation via motion sensing. In some embodiments, the processing engine 122 may include an acquisition module 410, a determination module 420, and a transmitting module 430. The modules may be hardware circuits of at least part of the processing engine 122. The modules may also be implemented as an application or set of instructions read and executed by the processing engine 122. Further, the modules may be any combination of the hardware circuits and the application/instructions. For example, the modules may be the part of the processing engine 122 when the processing engine 122 is executing the application or set of instructions.

The acquisition module 410 may acquire data related to music simulation. In some embodiments, the acquisition module 410 may acquire data associated with one or more simulation actions of a user simulating playing a specific musical instrument from at least one sensor. As used herein, the one or more simulation actions refer to one or more actions of the user simulating playing the specific musical instrument. A simulation action may be associated with a movement and/or posture of at least one part of the body of the user, such as a hand, a finger, an arm, a leg, the head, the lip, or the like, or any combination thereof. The processing engine acquisition module 410 may obtain the data associated with the one or more simulation actions of the user from at least one sensor in real-time or periodically. The at least one sensor may include but not limited to a camera, an accelerometer, a gyroscope, a position sensor, a pressure sensor, a barometric pressure sensor, a bending sensor, an infrared sensor, or the like, or any combination thereof. For instance, the data associated with a simulation action may include accelerations acquired by the accelerometer, a motion direction that the at least one sensor is moved toward acquired by the gyroscope, position data (e.g., a start position and/or an ending position of the at least one sensor) acquired by the position sensor, or the like, or any combination thereof.

The determination module 420 may determine data related to music simulation. In some embodiments, the determination module 420 may determine one or more simulation actions based on the data associated with the one or more simulation actions. The one or more simulation actions may include a waving action, a flapping action, a strumming action, a blowing action, or the like, or any combination thereof. Different simulation actions may correspond to different musical instruments. The determination module 420 may determine a simulation musical instrument that matches with the one or more simulation actions based on at least one of the one or more simulation actions and a mapping relationship between simulation actions and corresponding musical instruments. As used herein, the simulation musical instrument may refer to a musical instrument that the user simulates determined based on the one or more simulation actions.

In some embodiments, the determination module 420 may determine one or more first features associated with the simulation musical instrument based on the one or more simulation actions. For instance, the one or more first features may include a pronunciation intensity of the simulation musical instrument, a music rhythm of the simulation musical instrument, a pitch of the simulation musical instrument, a timbre of the simulation musical instrument, or the like, or any combination thereof. In some embodiments, the determination module 420 may play music based on the one or more first features. For instance, the determination module 420 may match a music score from a storage device (e.g., a music score database) based on the one or more features. As another example, the determination module 420 may determine one or more musical notes based on the one or more features.

In some embodiments, there may be a plurality of users simulating playing one or more specific musical instruments. The determination module 420 may determine a plurality of simulation musical instruments and determine multiple pieces of music based on a plurality features associated with the simulation actions performed by the plurality of users. Additionally or alternatively, the determination module 420 may generate a piece of synthesized music based on the plurality of features.

The transmitting module 430 may transmit data associated with music simulation. In some embodiments, the transmitting module 430 may transmit the musical score determined by the determination module 420 to a musical instrument (e.g., a smart piano). The musical instrument may play music based on the music score automatically. In some embodiments, the transmitting module 430 may transmit the one or more musical notes determined by the determination module 420 to the musical instrument. The musical instrument may play music according to the one or more musical notes. In some embodiments, the transmitting module 430 may transmit multiple pieces of music, multiple musical notes, or a piece of synthesized music to one or more musical instruments. The one or more musical instruments may perform a tutti based on the multiple pieces of music, multiple musical notes, or the piece of synthesized music.

It should be noted that the above description of the processing engine 122 is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. For instance, the processing engine 122 may further include a control module. The control module may be configured to control a musical instrument (e.g., the terminal 140) to play music according to the one or more music scores, the one or more musical notes, or the piece of synthesized music.

Figure 5:
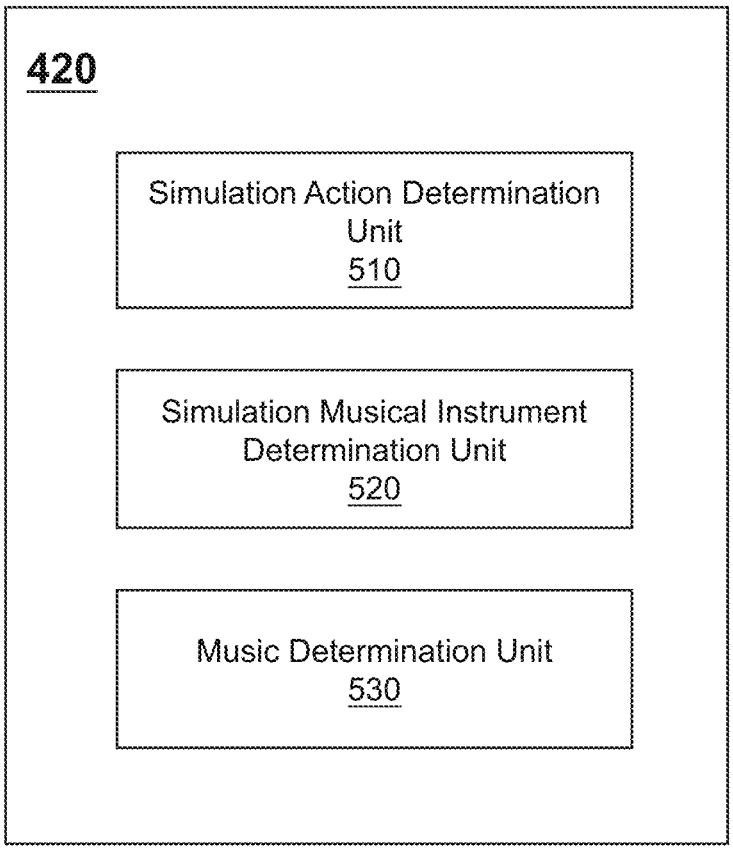
FIG. 5 is a block diagram illustrating a determination module according to some embodiments of the present disclosure.

FIG. 5 is a schematic diagram illustrating a determination module according to some embodiments of the present disclosure. In some embodiments, the determination module 420 may include a first simulation action determination unit 510, a simulation musical instrument determination unit 520, a simulation action determination unit 510 and a music determination unit 530. The units may be hardware circuits of at least part of the processing engine 122. The units may also be implemented as an application or set of instructions read and executed by the processing engine 122. Further, the units may be any combination of the hardware circuits and the application/instructions. For example, the units may be the part of the processing engine 122 when the processing engine 122 is executing the application or set of instructions.

The simulation action determination unit 510 may determine one or more simulation actions of a user. In some embodiments, a simulation action may be denoted by one or more action features. The one or more action features may include a motion trail, a motion amplitude, a motion rhythm, a posture (e.g., fingering), a motion intensity, position changes of the at least one part of the body of the user, etc. In some embodiments, the simulation action determination unit 510 may estimate and/or identify the actions features based on the data associated with the simulation actions of the user. For example, the simulation action determination unit 510 may determine the motion amplitude associated with a simulation action based on the displacement of the at least one portion of the body of the user (or the at least one sensor).

The simulation musical instrument determination unit 520 may determine a simulation musical instrument that matches with the one or more simulation actions based on at least one of the one or more simulation actions and a mapping relationship between simulation actions and corresponding musical instruments. In some embodiments, the mapping relationship between simulation actions and corresponding musical instruments may include one or more predetermined simulation actions and one or more corresponding predetermined musical instruments. Each of the one or more predetermined simulation actions may be associated with a user simulating playing a predetermined musical instrument.

In some embodiments, the simulation musical instrument determination unit 520 may determine one or more similarities between the one or more simulation actions and the predetermined simulation actions. The simulation musical instrument determination unit 520 may determine the simulation musical instrument based on the one or more similarities. In some embodiments, each of the one or more predetermined simulation actions in the predetermined dataset may correspond to only one predetermined simulation musical instrument. A predetermined simulation musical instrument that matches with a predetermined simulation action having the highest similarity may be designated as the simulation musical instrument that matches with the one or more simulation actions. In some embodiments, each of at least a portion of the one or more simulation actions may correspond to more than one predetermined musical instrument. The simulation musical instrument determination unit 520 may provide an option for the user to choose a simulation musical instrument from the more than one predetermined musical instrument that matches with a predetermined simulation action having the highest similarity, for example, via the terminal 140.

The music determination unit 530 may determine one or more music scores or one or more music notes. In some embodiments, the music determination unit 530 may match a music score from a storage device (e.g., a music score database) based on the one or more features associated with the one or more simulation actions. The music score may be transmitted to a musical instrument, for example. by the transmitting module 430. In some embodiments, the music determination unit 530 may determine one or more music notes. In some embodiments, the music determination unit 530 may control the musical instrument to play music according to the one or more features. For example, the music determination unit 530 may control the musical instrument to play music according to a pronunciation intensity of the simulation musical instrument, a music rhythm of the simulation musical instrument, a pitch of the simulation musical instrument, a timbre of the simulation musical instrument, or the like, or any combination thereof.

In some embodiments, there may be a plurality of users simulating playing one or more specific musical instruments. The music determination unit 530 may determine a plurality of simulation musical instruments and determine multiple pieces of music (also referred to as music scores) based on a plurality features associated with the simulation actions performed by the plurality of users. Additionally or alternatively, the music determination unit 530 may generate a piece of synthesized music based on the plurality of features.

It should be noted that the above description of the determination module 420 is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 6:
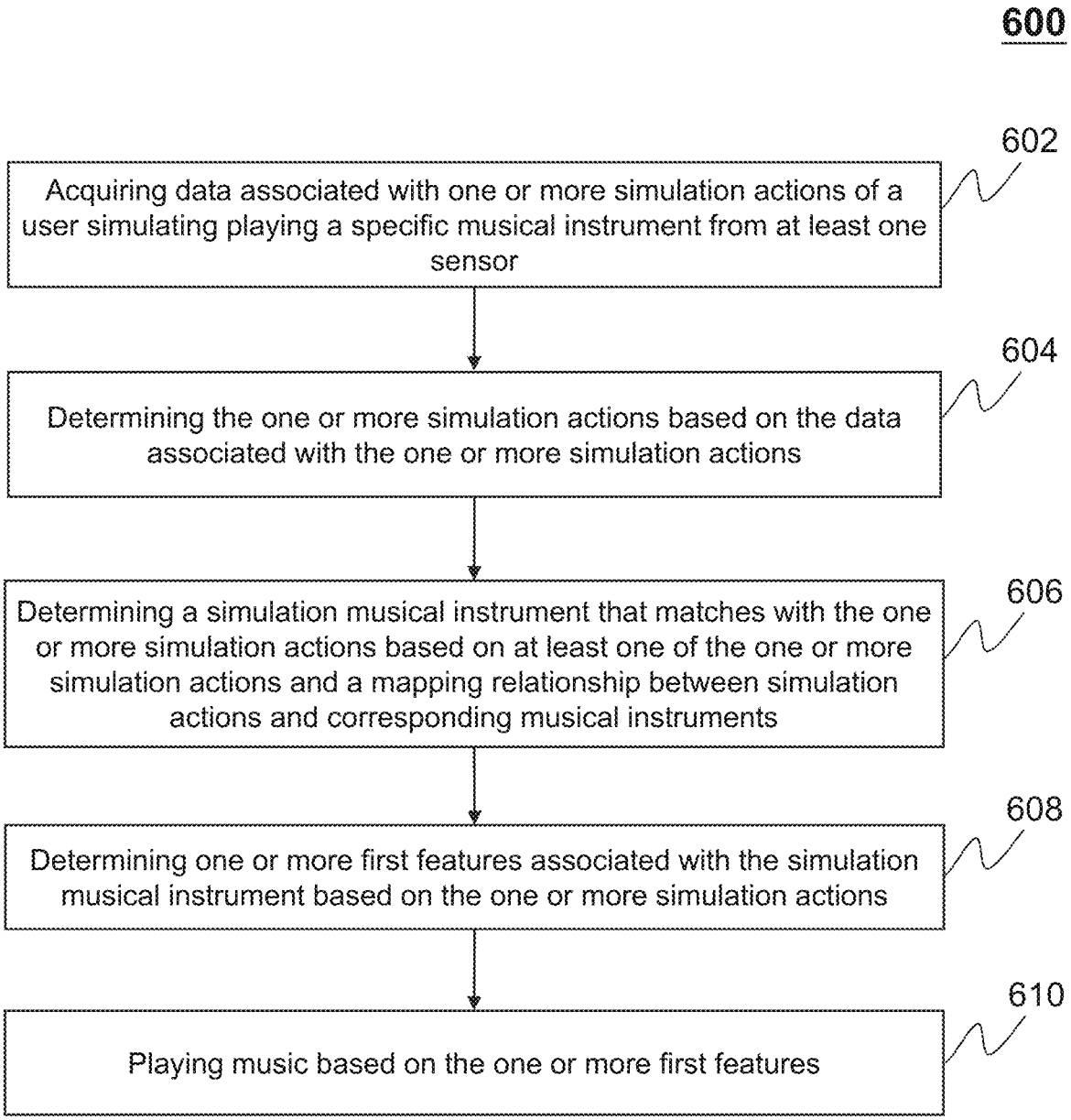
FIG. 6 is a flowchart illustrating a process for music simulation via motion sensing according to some embodiments of the present disclosure.

FIG. 6 is a flowchart illustrating a process for music simulation via motion sensing according to some embodiments of the present disclosure. In some embodiments, the process 600 may be implemented in the system 100. For example, the process 600 may be stored in the storage device 150 and/or the storage (e.g., the ROM 230, the RAM 240, etc.) as a form of instructions, and invoked and/or executed by the server 120 (e.g., the processing engine 122 in the server 120, or the processor 210 of the processing engine 122 in the server 120). The operations of the illustrated process 600 presented below are intended to be illustrative. In some embodiments, the process 600 may be accomplished with one or more additional operations not described, and/or without one or more of the operations discussed. Additionally, the order in which the operations of the process 600 as illustrated in FIG. 6 and described below is not intended to be limiting. As shown in FIG. 6, the process 600 may include the following operations.

In 602, the processing engine 122 (e.g., the acquisition module 410) may acquire data associated with one or more simulation actions of a user simulating playing a specific musical instrument from at least one sensor. As used herein, the one or more simulation actions refer to one or more actions of the user simulating playing the specific musical instrument. A simulation action may be associated with a movement and/or posture of at least one part of the body of the user, such as a hand, a finger, an arm, a leg, the head, the lip, or the like, or any combination thereof.

The processing engine 122 may obtain the data associated with the one or more simulation actions of the user from the at least one sensor in real-time or periodically. For example, the at least one sensor may store the data associated with the one or more actions of the user to the processing engine 122 in storage (e.g., the storage device 150). The processing engine 122 may obtain the data associated with the one or more simulation actions of the user from the storage at a predetermined time or after the user finishes simulating playing the specific musical instrument. The processing engine 122 may determine a piece of music and play the piece of music based on the one or more simulation actions performed in a time period by the user through operations 604-610. As another example, the at least one sensor may transmit the data associated with the one or more actions to the processing engine 122 in real time. The processing engine 122 may determine a musical note based on the one or more simulation actions of the user obtained at current time and play a piece of music based on the musical note in real time.

The at least one sensor may include a camera, an accelerometer, a gyroscope, a position sensor, a pressure sensor, a barometric pressure sensor, a bending sensor, an infrared sensor, or the like, or any combination thereof. In some embodiments, the at least one sensor may be implemented on a motion sensing device (e.g., the motion sensing device 110 in FIG. 1). The motion sensing device may include but not limited to a mobile device (e.g., a smart phone, a tablet computer), a wearable device, a camera, etc. The wearable device may include but not limited to a smart watch, a smart bracelet, a smart glove, a smart ring, or the like, or any combination thereof.

The specific musical instrument may include a keyboard instrument, a wind instrument, a string instrument, a percussion instrument, or the like, or any combination thereof. For example, the keyboard instrument may include a piano (e.g., an acoustic piano, an electric piano, an electronic piano, a digital piano, etc.), an organ (e.g., a pipe organ, a Hammond organ, etc.), an accordion, an electronic keyboard, or the like. The wind instrument may include a harmonica, a trumpet, a trombone, a euphonium, an oboe, a saxophone, a bassoon, or the like. The string instrument may include a guitar, a violin, an autoharp, a cimbalom, or the like. The percussion instrument may include a maraca, a timpani, a snare drum, a bass drum, a cymbal, a tambourine, or the like.

The data associated with the one or more simulation actions of the user may include a motion direction, a motion speed, a motion acceleration, a displacement, a posture (e.g., fingering), a pressure that the at least one part of the body imposes, etc. For instance, the data associated with a simulation action may include accelerations acquired by the accelerometer, a motion direction that the at least one sensor is moved toward acquired by the gyroscope, position data (e.g., a start position and/or an ending position of the at least one sensor) acquired by the position sensor, or the like, or any combination thereof. In some embodiments, the data associated with the one or more simulation actions of the user may be generated when the at least one sensor (or the motion sensing device) moves along with the movement of the at least one part of the body of the user when the user simulates playing the specific musical instrument. Merely by way of example, the user may wave a mobile device (e.g., a smart phone) held in a hand to simulate waving a maraca. As another example, the user may wear a wearable device (e.g., a smart watch) and wave his/or her hand(s) to simulate waving a maraca. In some embodiments, the data associated with the one or more simulation actions of the user may be generated without moving the motion sensing device. For instance, the user may beat/press the motion sensing device or tap on a screen of the motion sensing device to simulate playing a percussion instrument (e.g., a drum). As another example, the user may move his/her finger(s) across an icon representing a string displayed on the screen of the motion sensing device to simulate strumming the string of a guitar.

In some embodiments, the data associated with the one or more simulation actions of the user may be image data. For example, the at least one sensor may include a camera. The camera may catch the image data of the user simulating playing the specific musical instrument. The image data may present a motion trail, a motion amplitude, a motion direction, a motion speed, a motion acceleration, a displacement, a posture (e.g., fingering), etc., of the at least one part of the body of the user. The image data may include a plurality of images (frames) or a video. The processing engine 122 may identify the one or more simulation actions from the image data of the user.

In some embodiments, the data associated with the one or more simulation actions of the user may be generated based on a virtual reality technique. For example, the user may simulate playing the specific musical instrument via a virtual keyboard. The user may visually identify a plurality of virtual keys in the virtual keyboard and simulate playing the specific musical instrument (e.g., the piano) by tapping on the virtual keys. The actions of the user simulating playing the virtual keyboard may be caught by the at least one sensor (e.g., a camera) to generate the data associated with the one or more simulation actions. For example, if the at least one sensor includes a camera, the camera may acquire the image data. The image data may present the plurality of virtual keys and keys that the user presses.

In 604, the processing engine 122 (e.g., the determination module 420) may determine one or more simulation actions based on the data associated with the one or more simulation actions. The one or more simulation actions may include a waving action, a flapping action, a strumming action, a blowing action, or the like, or any combination thereof. Different simulation actions may correspond to different musical instruments. For example, the user may perform one or more waving actions to simulate playing a maraca. As another example, the user may perform one or more strumming actions to simulate playing a drum.

In some embodiments, a simulation action may be denoted by one or more action features. The one or more action features may include a motion trail, a motion amplitude, a motion rhythm, a posture (e.g., fingering), a motion intensity, position changes of the at least one part of the body of the user, etc. In some embodiments, the processing engine 122 may estimate and/or identify the actions features based on the data associated with the simulation actions of the user. For example, the processing engine 122 may determine the motion amplitude associated with a simulation action based on the displacement of the at least one portion of the body of the user (or the at least one sensor). The displacement may include a motion direction that the at least one sensor is moving toward and a motion distance between the start position and the ending position of the at least one sensor. For example, the motion distance of the simulation action may be determined based on the position data acquired by the position sensor. As another example, the processing engine 122 may determine the motion distance of the simulation action based on the acceleration acquired by the accelerometer and a duration of the simulation action. As yet another example, the processing engine 122 may determine the motion rhythm associated with a simulation action based on the speed and/or acceleration of the at least one portion of the body of the user (or the at least one sensor). As still another example, the processing engine 122 may determine the motion intensity associated with a simulation action based on the pressure that the at least one part of the body imposes on, for example, the at least one sensor. As still another example, the processing engine 122 may determine the motion trail associated with a simulation action based on the position change of the at least one part of the body of the user (or the at least one sensor). In some embodiments, the processing engine 122 may determine the simulation actions based on the action features. For example, the processing engine 122 may determine a simulation action as a waving action in response to determining that the motion trail corresponding to the simulation action is waved. As another example, the processing engine 122 may determine a simulation action as a flapping action or a strumming action in response to determining that a motion intensity, corresponding to the simulation action, is greater than a preset threshold. In some embodiments, the processing engine 122 may determine the one or more motion intensity based on the pressure data. The pressure data may include values of the pressure that the user applies on the at least one sensor at one or more time points when the user performs the one or more simulation actions based on the pressure data.

In some embodiments, the processing engine 122 may divide the data associated with the simulation actions into one or more groups. Each group may correspond to a simulation action. The simulation action may be determined based on each group of the data associated with the simulation actions. During the one or more simulation actions, the acceleration of the at least one sensor may vary. The processing engine 122 may divide the movement data into the one or more groups of movement data based on the variations of the acceleration.

In some embodiments, the data associated with the one or more simulation actions may be the image data as described elsewhere in the present disclosure. The processing engine 122 may determine the one or more simulation actions based on the image data. For example, the processing engine 122 may obtain a set of reference image data associated with a set of reference simulation actions. Each of the set of reference image data may correspond to one of the set of reference simulation actions. The processing engine 122 may further identify the one or more simulation actions by comparing the image data with the set of reference image data. As another example, the at least one sensor may be an infrared camera configured to obtain image data by projecting an infrared structured light (e.g., a structured light grid) on the user. When the user performs the one or more simulation actions, a pattern of the infrared structured light may change with the motion of the at least one part of the user. The processing engine 122 may determine the one or more simulation actions based on the structured light projected on the user.

The processing engine 122 (e.g., the simulation action determination unit 510) may determine at least one first simulation action for determining the specific musical instrument that the user simulates playing (also referred to as a simulation musical instrument). The processing engine 122 (e.g., the simulation action determination unit 510) may further determine one or more second simulation actions (also referred to as current simulation actions) in real-time, periodically, or after the user finishes the one or more second simulation actions. The one or more second simulation actions may be used to determine a piece of music in operations 608-610. As used herein, the first simulation action and the second simulation action may be collectively referred to as the simulation actions.

In 606, the processing engine 122 (e.g., the determination module 420 or the simulation musical instrument determination unit 520) may determine a simulation musical instrument that matches with the one or more simulation actions based on at least one of the one or more simulation actions and a mapping relationship between simulation actions and corresponding musical instruments. As used herein, the simulation musical instrument may refer to a musical instrument that the user simulates determined based on the one or more simulation actions. The simulation musical instrument determined in operation 606 may be the same or different from the specific musical instrument as described in operation 602. For example, the user may want to simulate playing the guitar (i.e., the specific musical instrument). The simulation musical instrument determined based on the simulation actions of the user may be a zither. As another example, the user may want to simulate playing the piano (i.e., the specific musical instrument). The simulation musical instrument determined based on the simulation actions of the user may be also a piano.

The mapping relationship between simulation actions and corresponding musical instruments may provide matches between simulation actions and corresponding musical instruments. In some embodiments, the mapping relationship between simulation actions and corresponding musical instruments may provide a match between one single simulation action and one single musical instrument. In some embodiments, the mapping relationship between simulation actions and corresponding musical instruments may provide a match between multiple simulation actions and one single musical instrument. In some embodiments, the mapping relationship between simulation actions and corresponding musical instruments may provide a match between one single simulation action and multiple musical instruments.

In some embodiments, the mapping relationship between simulation actions and corresponding musical instruments may include one or more predetermined simulation actions and one or more corresponding predetermined musical instruments. Each of the one or more predetermined simulation actions may be associated with a user simulating playing a predetermined musical instrument. In some embodiments, the processing engine 122 may determine one or more similarities between the one or more simulation actions and the predetermined simulation actions. The processing engine 122 may determine the simulation musical instrument based on the one or more similarities. In some embodiments, each of the one or more predetermined simulation actions in the predetermined dataset may correspond to only one predetermined simulation musical instrument. A predetermined simulation musical instrument that matches with a predetermined simulation action having the highest similarity may be designated as the simulation musical instrument that matches with the one or more simulation actions. In some embodiments, each of at least a portion of the one or more simulation actions may correspond to more than one predetermined musical instrument. The simulation musical instrument determination unit 520 may provide an option for the user to choose a simulation musical instrument from the more than one predetermined musical instrument that matches with a predetermined simulation action having the highest similarity, for example, via the terminal 140.

In 608, the processing engine 122 (e.g., the determination module 420 or the music determination unit 530) may determine one or more first features associated with the simulation musical instrument based on the one or more simulation actions. In some embodiments, the processing engine 122 may determine the one or more first features based on the one or more simulation actions in real time, periodically, or after the user finishes the one or more simulation actions.

In some embodiments, the one or more first features may include a pronunciation intensity of the simulation musical instrument, a music rhythm of the simulation musical instrument, a pitch of the simulation musical instrument, a timbre of the simulation musical instrument, or the like, or any combination thereof. As used herein, the pronunciation intensity may define the loudness or softness of a piece of music associated with the simulation musical instrument. The music rhythm (also referred to as tempo) may define a speed or pace of the piece of music associated with the simulation musical instrument. The pitch of the simulation musical instrument may define a sound of the piece of music associated with the simulation musical instrument based on a frequency of the sound. For example, a high pitch may be a sound with a relatively high frequency, and a low pitch may be a sound with a relatively low frequency. The timbre of the simulation musical instrument may be a perceived sound quality of the sound produced by the specific musical instrument that the user simulates playing. Each type of musical instruments may have a distinctive timbre that is different from other types of musical instruments.

In some embodiments, the processing engine 122 may determine the one or more first features based on the action features (e.g., one or more second features) associated with the one or more simulation actions. The one or more second features associated with the one or more simulation actions may include but not limited to one or more motion amplitudes of the one or more simulation actions, a motion rhythm of the one or more simulation actions, a motion intensity of the one or more simulation actions, position data associated with the one or more simulation actions, or the like, or any combination thereof. In some embodiments, the processing engine 122 may determine one or more pronunciation intensities of the simulation musical instrument based on the one or more motion amplitudes of the one or more simulation actions. For example, the greater the motion amplitude is, the greater the pronunciation intensity of the simulation musical instrument may be. In some embodiments, the processing engine 122 may determine the music rhythm of the simulation musical instrument based on the rhythm of the one or more simulation actions. In some embodiments, the processing engine 122 may determine the pitch of the simulation musical instrument based on the image data acquired by the at least one sensor. Merely by way of example, the image data may include a virtual keyboard of a piano projected on a flat surface. The virtual keyboard may have a plurality of virtual keys corresponding to a plurality of pitches. The processing engine 122 may identify one or more virtual keys that the user has tapped on from the image data and determine the pitch of the simulation musical instrument based on the one or more pitches corresponding to the one or more virtual keys. In some embodiments, the processing engine 122 may designate the timbre of the specific musical instrument that the user simulates playing as the timbre of the simulation musical instrument.

In 610, the processing engine 122 (e.g., the determination module 420 or the music determination unit 530) may play music based on the one or more first features. In some embodiments, the processing engine 122 may match a music score from a storage device (e.g., a music score database) based on the one or more features. The processing engine 122 may transmit the music score to a musical instrument (e.g., a smart piano). The musical instrument may play music based on the music score automatically. In some embodiments, the processing engine 122 may control the musical instrument to play music according to the one or more features. For example, the processing engine 122 may control the musical instrument to play music according to a pronunciation intensity of the simulation musical instrument, a music rhythm of the simulation musical instrument, a pitch of the simulation musical instrument, a timbre of the simulation musical instrument, or the like, or any combination thereof, determined in operation 608.

In some embodiments, the processing engine 122 may make and/or determine a piece of music associated with a simulation musical instrument based on the pronunciation intensity of the simulation musical instrument, the music rhythm of the simulation musical instrument, the pitch of the simulation musical instrument, the timbre of the simulation musical instrument, or the like, or any combination thereof. In some embodiments, the processing engine 122 (e.g., the transmitting module 430) may transmit the piece of music to a motion sensing device (e.g., the motion sensing device(s) 110), a musical instrument terminal (e.g., the terminal 140), etc., via a wired connection (e.g., cables) or wireless connection (e.g., Bluetooth). The motion sensing device (e.g., the motion sensing device(s) 110) and/or the musical instrument terminal may play the piece of music. For example, the musical instrument terminal may include earphones or a loudspeaker. In some embodiments, the loudspeaker may be implemented on the terminal 140. In some embodiments, the musical instrument terminal may play the piece of music immediately after the piece of music is determined based on the one or more first features, which allows the user to hear the piece of music associated with the one or more simulation actions in real-time. In some embodiments, the processing engine 122 may transmit one or more pieces of music to a storage device (e.g., the storage device 150) for storage.

In some embodiments, there may be a plurality of users simulating playing one or more specific musical instruments. The plurality of users may simulate playing the same musical instrument or different musical instruments to perform a tutti. For example, a user A may simulate playing a guitar, a user B may simulate playing a piano, and a user C may simulate beating a drum. In some embodiments, at least two of the plurality of users may simulate playing the same musical instrument or different musical instruments according to at least two different music scores related to the tutti. In some embodiments, at least two of the plurality of users may simulate playing the same musical instrument according to at least two sub-scores that belong to a same musical score related to the tutti. The at least two sub-scores may be the same or different. The processing engine 122 may determine a plurality of simulation musical instruments and determine multiple pieces of music based on a plurality of groups of first features associated with the simulation actions performed by the plurality of users.

The tutti may be performed based on at least two pieces of music associated with at least two of the simulation musical instruments. In some embodiments, there may be a plurality of musical instrument terminals and each of the plurality of musical instrument terminals may play a piece of music associated with a simulation musical instrument. In some embodiments, the processing engine 122 may generate a piece of synthesized music based on the at least two pieces of music. The piece of synthesized music may be transmitted to one or more musical instrument terminals for playing the piece of synthesized music. For instance, when the plurality of users are in a same place (e.g., a same house, a same campsite), the piece of synthesized music may be transmitted to a single musical instrument terminal for playing the piece of synthesized music. As another example, when the plurality of users are not in the same place, the piece of synthesized music may be transmitted to multiple musical instruments associated with the plurality of users. Each of the multiple musical instruments may play the piece of synthesized music. In some embodiments, the processing engine 122 may transmit the plurality of pieces of music or one or more piece of synthesized music to a storage device (e.g., the storage device 150) for storage.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. In some embodiments, operations 602-610 may be performed by one or more devices. For example, operations 602-610 may be performed by a motion sensing device having at least one sensor and at least one processing engine. As another example, operations 602-608 may be performed by a server having at least one processing engine, and operation 610 may be performed by a musical instrument terminal having at least one processing engine. As yet another example, operations 602-610 may be performed by a user terminal (e.g., the terminal 140 in FIG. 1).

Figure 7:
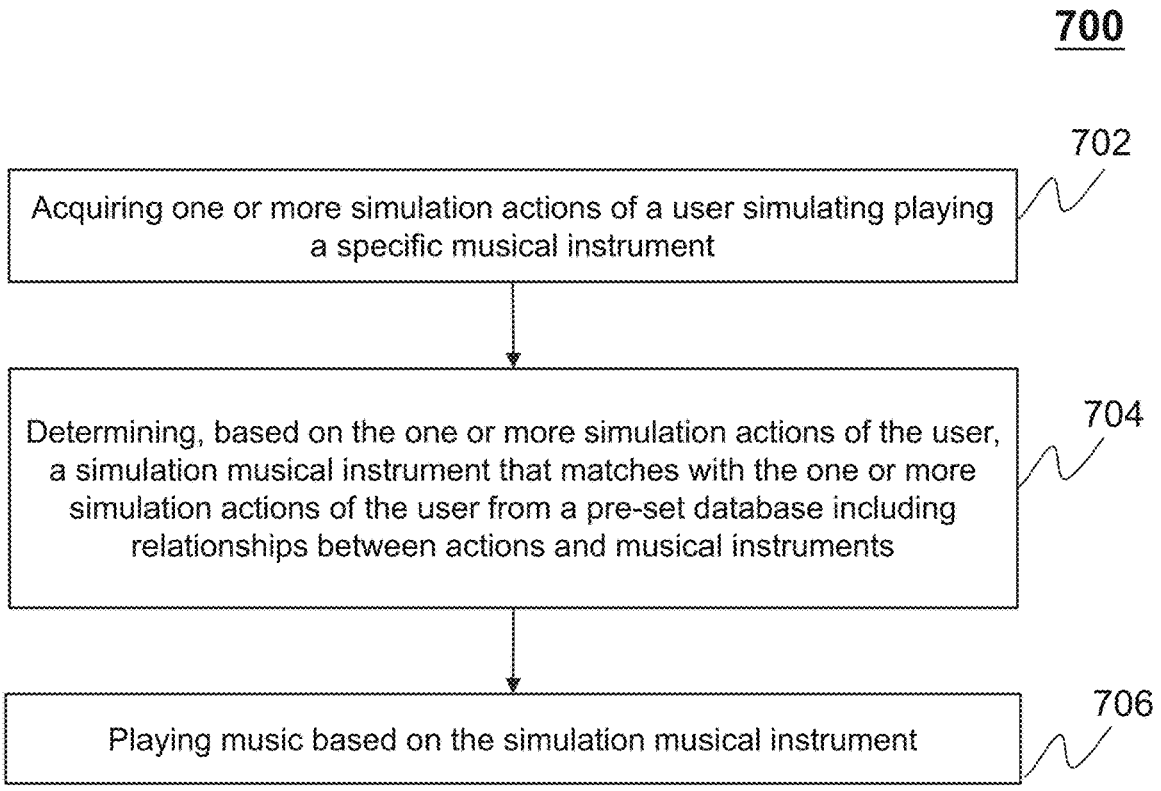
FIG. 7 is a flowchart illustrating a process for music simulation via motion sensing according to some embodiments of the present disclosure.

FIG. 7 is a flowchart illustrating a process 700 for music simulation via motion sensing according to some embodiments of the present disclosure. In some embodiments, the process 700 may be implemented on a motion sensing device. The motion sensing device may be configured with at least one sensor (e.g., an accelerometer) and a processing engine (e.g., the processing engine 122). In some embodiments, the process 700 may be implemented in the system 100. For example, process 700 may be implemented on the motion sensing device 110. As another example, the process 700 may be stored in the storage device 150 and/or the storage (e.g., the ROM 230, the RAM 240, etc.) as a form of instructions, and invoked and/or executed by the server 120 (e.g., the processing engine 122 in the server 120, or the processor 210 of the computing device 200).

In 702, the motion sensing device (e.g., the motion sensing device(s) 110) may acquire one or more simulation actions of a user simulating playing a specific musical instrument. As used herein, acquiring one or more simulation actions of a user may refer to acquiring data associated with the one or more simulation actions of the user.

In some embodiments, an accelerometer installed on the motion sensing device may acquire a motion distance and a motion direction generated by the user moving the motion sensing device. The motion sensing device (e.g., the motion sensing device(s) 110) may further determine the one or more simulation actions of the user based on the motion distance and the motion direction.

The one or more simulation actions of the user may include different types of actions, such as a waving action, a flapping action, a strumming action, a blowing action, or the like, or any combination thereof. For instance, the user may wave a hand and/or the motion sensing device to simulate waving a maraca, gently flap on the motion sensing device to simulate beating a drum, move his/or fingers across a screen of the motion sensing device or flap on the screen to simulate strumming a string instrument (e.g., a guitar), blow at a microphone to simulate playing a wind instrument, or the like.

In 704, the motion sensing device (e.g., the motion sensing device(s) 110) may determine, based on the one or more simulation actions of the user, a simulation musical instrument that matches with the one or more simulation actions of the user from a predetermined dataset including relationships between actions and musical instruments.

In some embodiments, the motion sensing device may continuously acquire a plurality of images associated with the one or more simulation actions to generate one or more image sets.

In the predetermined dataset including relationships between actions and musical instruments, in some embodiments, each action or each image set may correspond to only one musical instrument. In some embodiments, more than one action may correspond to only one musical instrument. Alternatively, each action may correspond to more than one musical instrument. When each action corresponds to more than one musical instrument, a selection interface may appear on a screen of a user terminal (e.g., the terminal 140). The user may select the simulation musical instrument corresponding to the one or more simulation actions from the more than one musical instrument via the selection interface.

In 706, the motion sensing device may play music based on the simulation musical instrument. In some embodiments, the motion sensing device may obtain the simulation actions of the user during a time period. The motion sensing device may determine and/or make a piece of music based on the one or more simulation actions during the time period. The motion sensing device may play the piece of music via a loudspeaker, a headset, a pair of earphones, or the like. In some embodiments, the motion sensing device may obtain more simulation actions of the user in real time. The motion sensing device may determine a musical note based on one or more simulation actions of the user obtained at current time. The motion sensing device may play music based on the musical note in real time. Details regarding the determination of the piece of music may be found elsewhere in the present disclosure, for example, in FIG. 6 and FIG. 8, and the descriptions thereof.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 8:
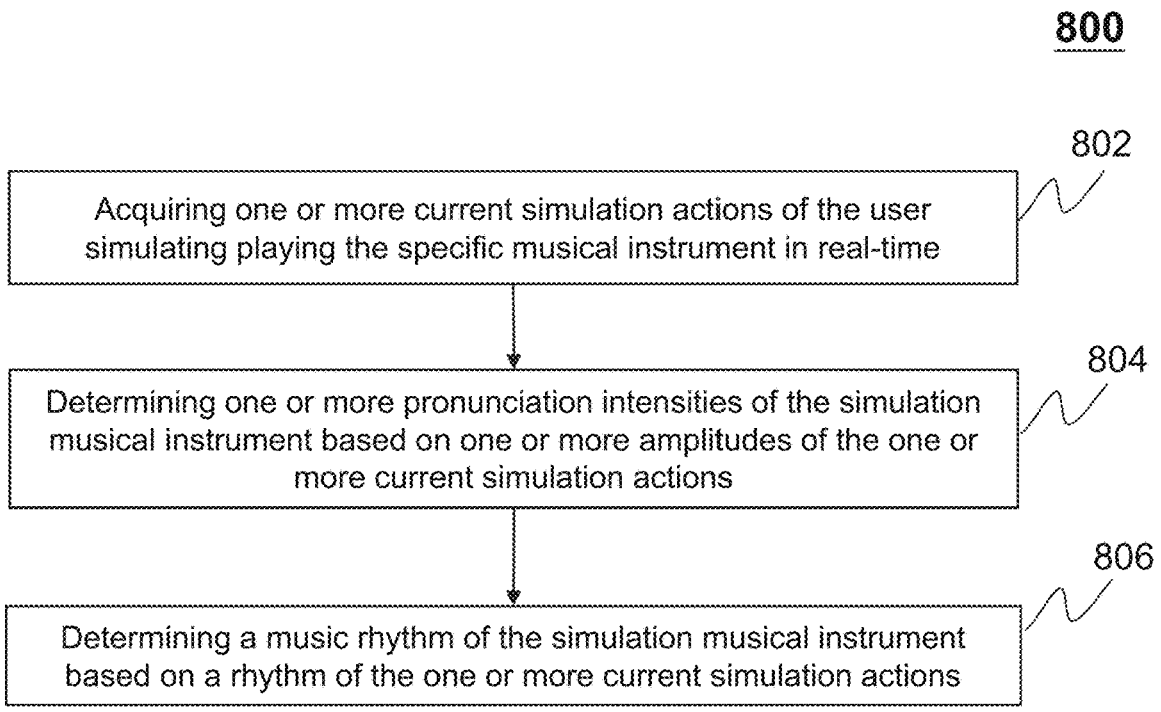
FIG. 8 is a flowchart illustrating a process for playing music based on the simulation musical instrument according to some embodiments of the present disclosure.

FIG. 8 is a flowchart illustrating a process for playing music based on the simulation musical instrument according to some embodiments of the present disclosure. In some embodiments, the process 700 may be implemented on a motion sensing device. The motion sensing device may be configured with at least one sensor (e.g., an accelerometer) and a processing engine (e.g., the processing engine 122). In some embodiments, the process 800 may be implemented in the system 100. For example, process 800 may be implemented on the motion sensing device 110. As another example, the process 800 may be stored in the storage device 150 and/or the storage (e.g., the ROM 230, the RAM 240, etc.) as a form of instructions, and invoked and/or executed by the server 120 (e.g., the processing engine 122 in the server 120, or the processor 210 of the computing device 200).

In 802, the motion sensing device may acquire one or more current simulation actions of the user simulating playing the specific musical instrument in real-time.

In 804, the motion sensing device may determine one or more pronunciation intensities of the simulation musical instrument based on one or more amplitudes of the one or more current simulation actions.

The one or more amplitudes of the one or more current simulation actions may correspond to the one or more pronunciation intensities of the simulation musical instrument. Specifically, the greater the one or more amplitudes of the one or more current simulation actions are, the higher the one or more pronunciation intensities may be.

In 806, the motion sensing device may determine a music rhythm of the simulation musical instrument based on a rhythm of the one or more current simulation actions.

In some embodiments, as described in connection with FIG. 7 and FIG. 8, the motion sensing device may process data associated with the one or more simulation actions of the user, obtain the relationships between actions and musical instruments, determine the simulation musical instrument corresponding to the one or more simulation actions of the user, and play music based on the simulation musical instrument.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. For example, operations 804 and 806 may be performed simultaneously or in any order.

Figure 9:
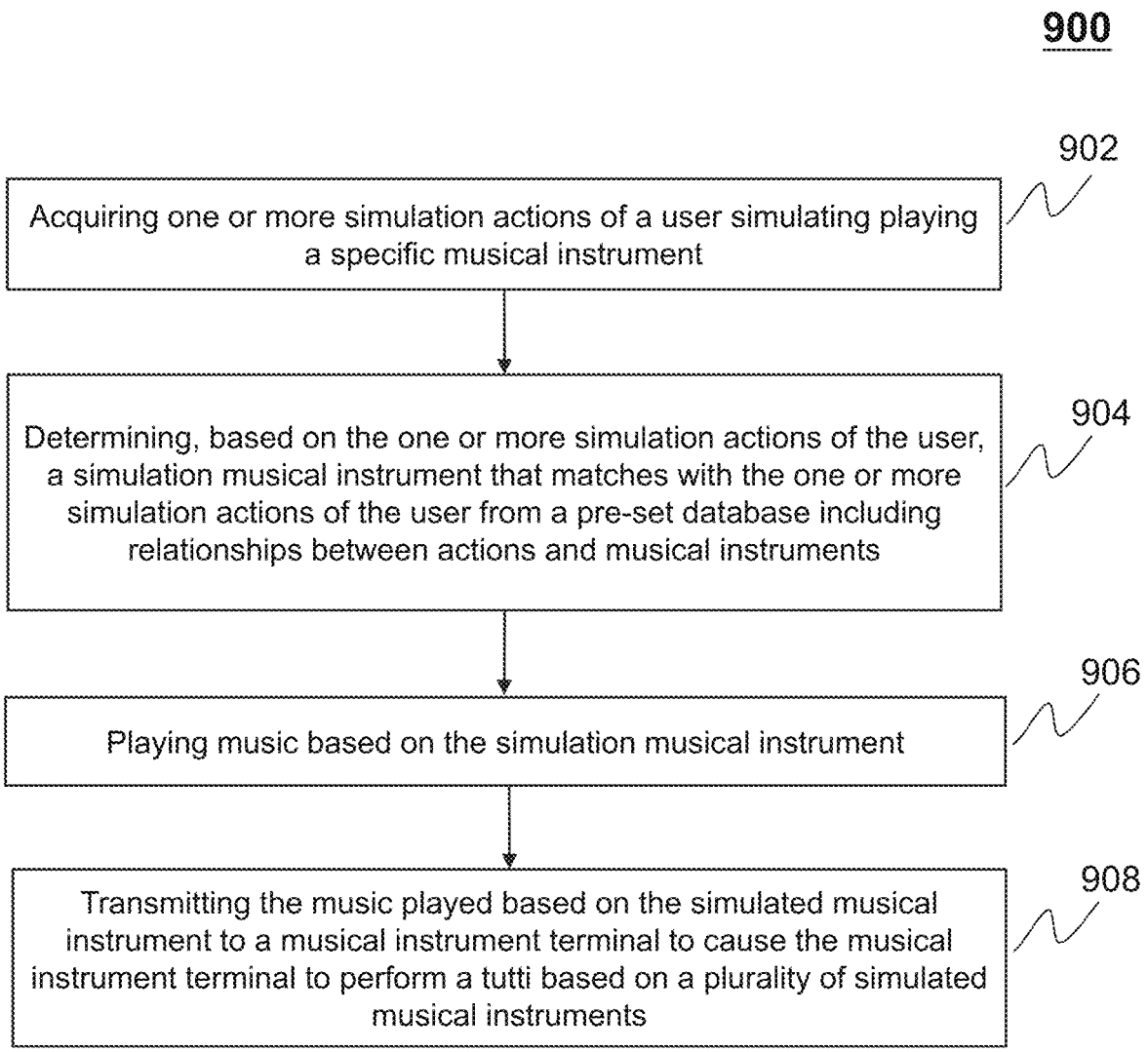
FIG. 9 is a flowchart illustrating a process for music simulation via motion sensing according to some embodiments of the present disclosure.

FIG. 9 is a flowchart illustrating a process for music simulation via motion sensing according to some embodiments of the present disclosure. In some embodiments, the process 700 may be implemented on a motion sensing device. The motion sensing device may be configured with at least one sensor (e.g., an accelerometer), a processing engine (e.g., the processing engine 122). In some embodiments, the process 900 may be implemented in the system 100. For example, process 900 may be implemented on the motion sensing device 110. As another example, the process 900 may be stored in the storage device 150 and/or the storage (e.g., the ROM 230, the RAM 240, etc.) as a form of instructions, and invoked and/or executed by the server 120 (e.g., the processing engine 122 in the server 120, or the processor 210 of the computing device 200).

In 902, the motion sensing device may acquire one or more simulation actions of a user simulating playing a specific musical instrument.

In 904, the motion sensing device (e.g., the processing engine 122) may determine, based on the one or more simulation actions of the user, a simulation musical instrument that matches with the one or more simulation actions of the user from a predetermined dataset including relationships between actions and musical instruments.

In 906, the motion sensing device may play music based on the simulation musical instrument.

The motion sensing device may perform operations 902 to 906 in a similar manner to operations 702 to 706 in the process 700 in FIG. 7 and/or operations 802 to 806 in process 800 in FIG. 8.

In 908, the motion sensing device may transmit the music played based on the simulation musical instrument to a musical instrument terminal to cause the musical instrument terminal to perform a tutti on the music determined in operation 906 and other music determined based on a plurality of other simulation musical instruments.

The musical instrument terminal may include but not limited to a smart piano, a sound equipment (e.g., a loudspeaker or a headset), or the like. The musical instrument terminal may perform a tutti on multiple pieces of music played based on a plurality of simulation musical instruments. In this case, a plurality of users may play music according to a plurality of sub-scores that belong to a same music score via a plurality of motion sensing devices to generate multiple pieces of music. The tutti of multiple pieces of music may be played by a same musical instrument terminal or a plurality of musical instrument terminals or a plurality of musical instrument terminals.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 10:
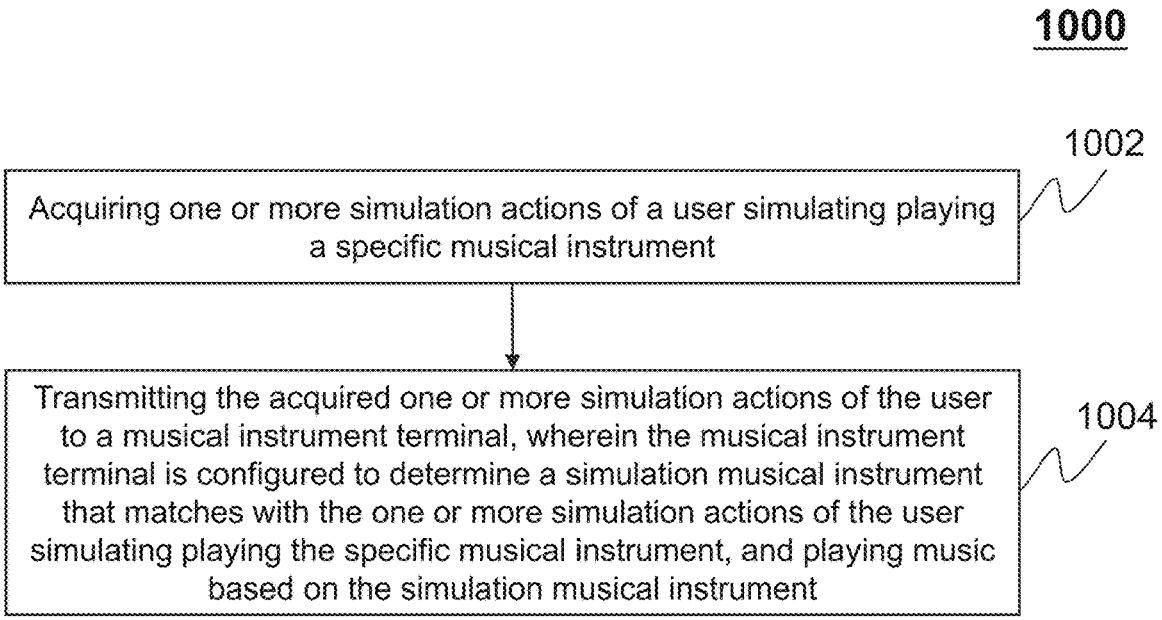
FIG. 10 is a flowchart illustrating a process for music simulation via motion sensing according to some embodiments of the present disclosure.

FIG. 10 is a flowchart illustrating a process for music simulation via motion sensing according to some embodiments of the present disclosure. In some embodiments, the process 1000 may be implemented on a motion sensing device. The motion sensing device may be configured with at least one sensor (e.g., an accelerometer) and a processing engine (e.g., the processing engine 122). In some embodiments, the process 1000 may be implemented in the system 100. For example, the process 1000 may be stored in the storage device 150 and/or the storage (e.g., the ROM 230, the RAM 240, etc.) as a form of instructions, and invoked and/or executed by the server 120, the motion sensing device(s) 110 and/or the terminal 140 (e.g., the processing engine 122 in the server 120, or the processor 210 of the computing device 200). The difference between the process 700 and the process 1000 is that in the process 1000, the motion sensing device may acquire data associated with the one or more simulation actions of the user simulating playing a specific musical instrument and transmit the acquired data associated with the one or more simulation actions to a musical instrument terminal. The musical instrument terminal may determine a simulation musical instrument that matches with the one or more simulation actions of the user simulating playing the specific musical instrument and playing music based on the simulation musical instrument. Specifically, the process 1000 may include the following operations.

In operation 1002, the motion sensing device (e.g., the at least one sensor) may acquire one or more simulation actions of a user simulating playing a specific musical instrument.

In some embodiments, an accelerometer installed on the motion sensing device may acquire a motion distance and a motion direction generated by the user moving the motion sensing device. The motion sensing device (e.g., the motion sensing device(s) 110) may further determine the one or more simulation actions of the user based on the motion distance and the motion direction.

The one or more simulation actions of the user may include different types of actions, such as a waving action, a flapping action, a strumming action, a blowing action, or the like, or any combination thereof. For instance, the user may wave a hand and/or the motion sensing device to simulate waving a maraca, gently flap on the motion sensing device to simulate beating a drum, move his/or fingers across a screen of the motion sensing device or flap on the screen to simulate strumming a string instrument (e.g., a guitar), blow at a microphone to simulate playing a wind instrument, or the like.

In operation 1004, the motion sensing device may transmit the acquired one or more simulation actions of the user to a musical instrument terminal. The musical instrument terminal may be configured to determine a simulation musical instrument that matches with the one or more simulation actions of the user simulating playing the specific musical instrument, and play music based on the simulation musical instrument.

The acquired one or more simulation actions (or the data associated with the one or more simulation actions) may be transmitted to the musical instrument terminal (e.g., a smart piano) via a wireless connection such as the wireless fidelity (WiFi) or the Bluetooth. A processing engine in the smart piano may determine the relationship between the one or more simulation action and the simulation musical instrument.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 11:
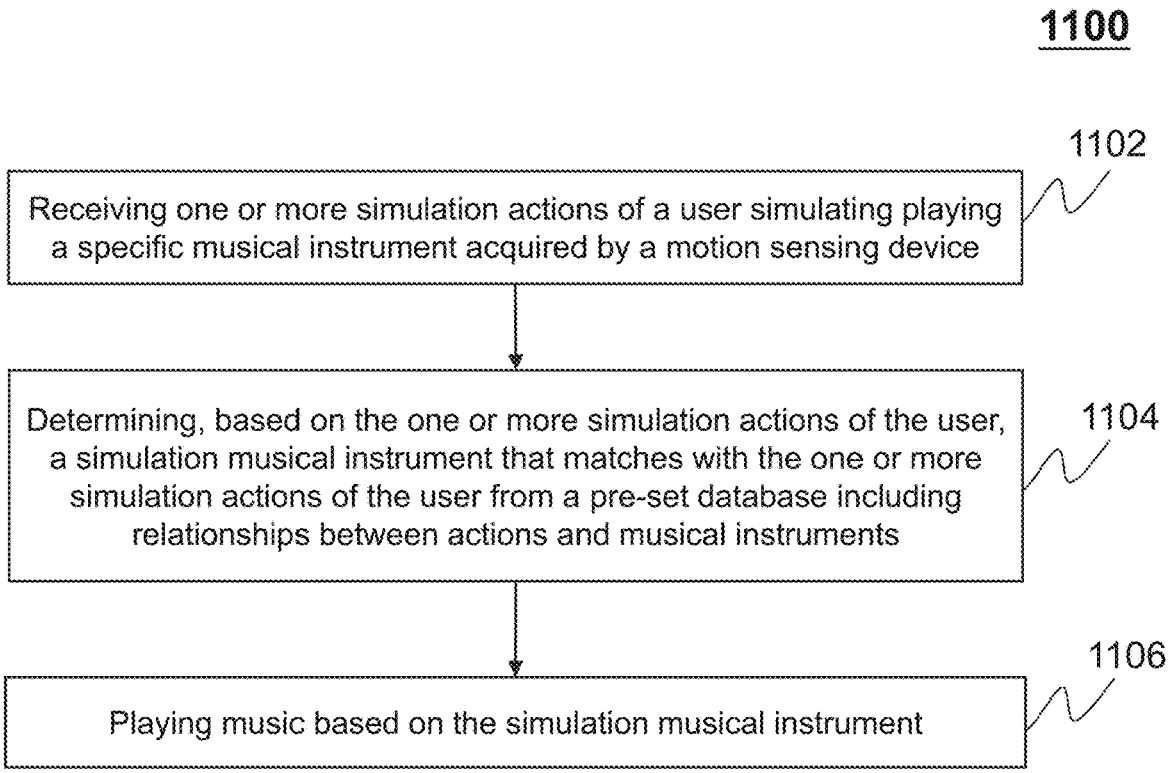
FIG. 11 is a flowchart illustrating a process for music simulation via motion sensing according to some embodiments of the present disclosure.

FIG. 11 is a flowchart illustrating a process 1100 for music simulation via motion sensing according to some embodiments of the present disclosure. The process 1100 may be implemented on a musical instrument terminal. The musical instrument terminal may include at least one processor and at least one storage device. In some embodiments, the process 1100 may be implemented in the system 100. For example, the process 1100 may be stored in the storage device 150 and/or the storage (e.g., the ROM 230, the RAM 240, etc.) as a form of instructions, and invoked and/or executed by the server 120, the terminal 140, and/or the motion sensing device(s) 110 (e.g., the processing engine 122 in the server 120, or the processor 210 of the computing device 200).

In 1102, the musical instrument terminal may receive one or more simulation actions of a user simulating playing a specific musical instrument acquired by a motion sensing device.

The motion sensing device may be configured with at least one sensor, such as a camera, an accelerometer, etc. For example, the motion sensing device may continuously acquire one or more images associated with the one or more simulation actions to generate a set of images. The musical instrument terminal may receive the set of images.

In 1104, the musical instrument terminal may determine, based on the one or more simulation actions of the user, a simulation musical instrument that matches with the one or more simulation actions of the user from a predetermined dataset including relationships between actions and musical.

In some embodiments, in the predetermined dataset including relationships between actions and musical instruments, each action or each image set may correspond to one musical instrument. In some embodiments, more than one action may correspond to one musical instrument. Alternatively, each action may correspond to more than one musical instrument. When each action corresponds to more than one musical instrument, a selection interface may appear on a screen of a user terminal (e.g., the terminal 140). The user may select a simulation musical instrument corresponding to the one or more simulation actions. In some embodiments, the musical instrument terminal may be implemented on the user terminal.

In 1106, the musical instrument terminal may play music based on the simulation musical instrument. For instance, a processor of the musical instrument terminal may determine a piece of music based on the one or more simulation actions. In some embodiments, the musical instrument terminal may receive the simulation actions of the user during a time period in operation 1102. The musical instrument terminal may determine and/or make a piece of music based on the one or more simulation actions during the time period. The musical instrument terminal may play the piece of music via a sound equipment, such as a loudspeaker, a headset, a pair of earphones, or the like. In some embodiments, the musical instrument terminal may receive the simulation actions of the user in real time. The musical instrument terminal may determine a musical note based on one or more simulation actions of the user obtained at current time. The motion sensing device may play music based on the musical note in real time. Details regarding the determination of the piece of music may be found elsewhere in the present disclosure, for example, in FIG. 6 and FIG. 12, and the descriptions thereof.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 12:
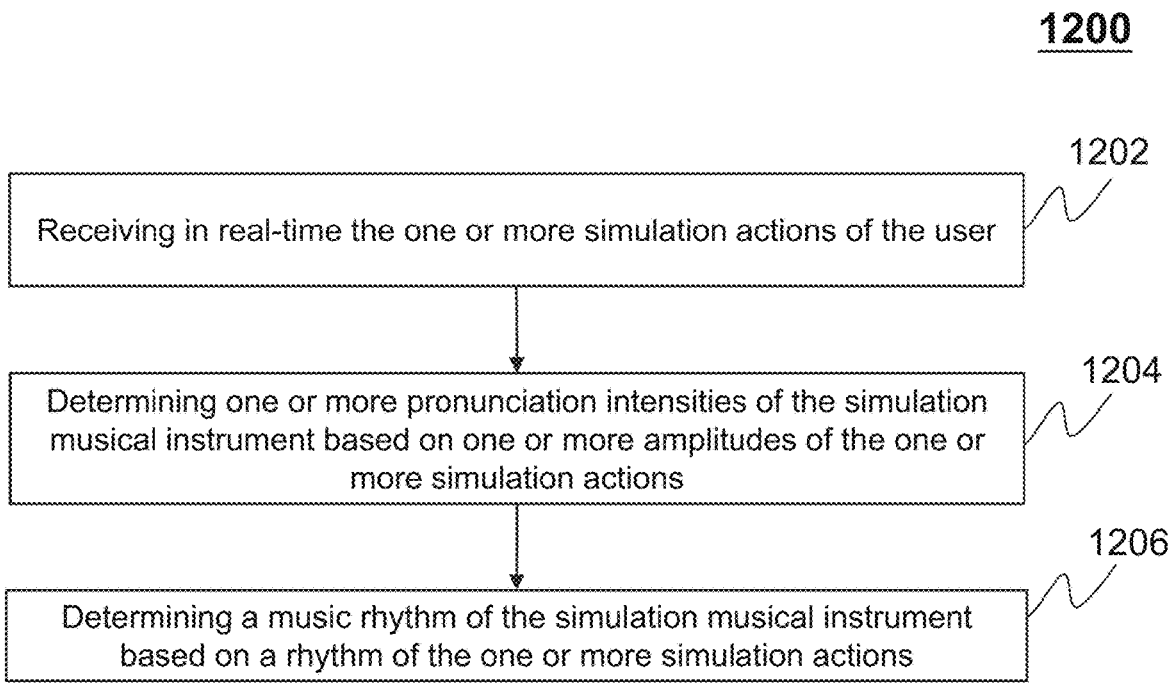
FIG. 12 is a flowchart illustrating a process for playing music based on the simulation musical instrument according to some embodiments of the present disclosure.

FIG. 12 is a flowchart illustrating a process for playing music based on the simulation musical instrument according to some embodiments of the present disclosure. The process 1200 may be implemented on a musical instrument terminal. The musical instrument terminal may include at least one processor and at least one storage device. In some embodiments, the process 1200 may be implemented in the system 100. For example, the process 1200 may be stored in the storage device 150 and/or the storage (e.g., the ROM 230, the RAM 240, etc.) as a form of instructions, and invoked and/or executed by the server 120 (e.g., the processing engine 122 in the server 120, or the processor 210 of the processing engine 122 in the server 120).

In 1202, the musical instrument terminal may receive in real-time the one or more simulation actions of the user.

In 1204, the musical instrument terminal may determine one or more pronunciation intensities of the simulation musical instrument based on an amplitude of the one or more simulation actions. The one or more amplitudes of the one or more current simulation actions may correspond to the one or more pronunciation intensities of the simulation musical instrument. Specifically, the greater the one or more amplitudes of the one or more current simulation actions are, the higher the one or more pronunciation intensities may be.

In 1206, the musical instrument terminal may determine a music rhythm of the simulation musical instrument based on a rhythm of the one or more simulation actions.

In some embodiments, as described in connection with FIG. 11 and FIG. 12, the motion sensing device may acquire the data associated with the one or more simulation actions of the user and transmit the data associated with the one or more simulation actions to the musical instrument terminal. The musical instrument terminal may process the data associated with the one or more simulation actions, obtain the relationships between actions and musical instruments, determine the simulation musical instrument associated with the one or more simulation actions of the user, and play music based on the simulation musical instrument.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure. For example, operations 1204 and 1206 may be performed simultaneously or in any order.

Figure 13:
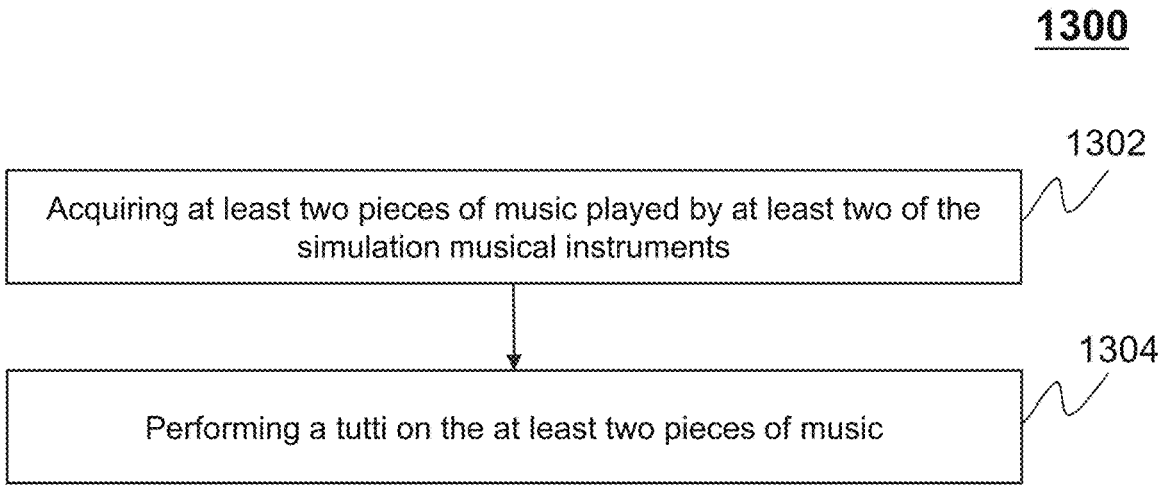
FIG. 13 is a flowchart illustrating a process for music simulation via motion sensing according to some embodiments of the present disclosure.

FIG. 13 is a flowchart illustrating a process for music simulation via motion sensing according to some embodiments of the present disclosure. The process 1300 may be implemented on a musical instrument terminal. The musical instrument terminal may include at least one processor and at least one storage device. The process 1300 may be implemented on a musical instrument terminal. The musical instrument terminal may include at least one processor and at least one storage device. In some embodiments, the process 1300 may be implemented in the system 100. For example, the process 1300 may be stored in the storage device 150 and/or the storage (e.g., the ROM 230, the RAM 240, etc.) as a form of instructions, and invoked and/or executed by the server 120, the terminal 140, and/or the motion sensing device(s) 110 (e.g., the processing engine 122 in the server 120, or the processor 210 of the computing device 200).

In 1302, the musical instrument terminal may acquire at least two pieces of music played by at least two of the simulation musical instruments.

In 1304, the musical instrument terminal may perform a tutti on the at least two pieces of music.

The musical instrument terminal may receive the data associated with the one or more simulation actions of each of a plurality of users. The musical instrument terminal may process the data associated with the one or more simulation actions of each of the plurality of users to determine a simulation musical instrument corresponding to each of the plurality of users. The musical instrument terminal may further determine multiple pieces of music based on the simulation musical instrument for each of the plurality of users. The tutti of the multiple pieces of music may be performed by the musical instrument terminal. For example, the musical instrument terminal may be a smart piano including a screen, a processor (e.g., processing engine 122), and a wireless communication module (e.g., the acquisition module 410 and the transmitting module 430 in FIG. 4). The processor of the musical instrument terminal may generate a piece of synthesized music. In some embodiments, each of the plurality of users may perform the one or more simulation actions to simulate playing a specific musical instrument (e.g., a piano, a drum, a guitar) according to a sub-score. A plurality of sub-scores for the plurality of users may belong to a same music score.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Figure 14:
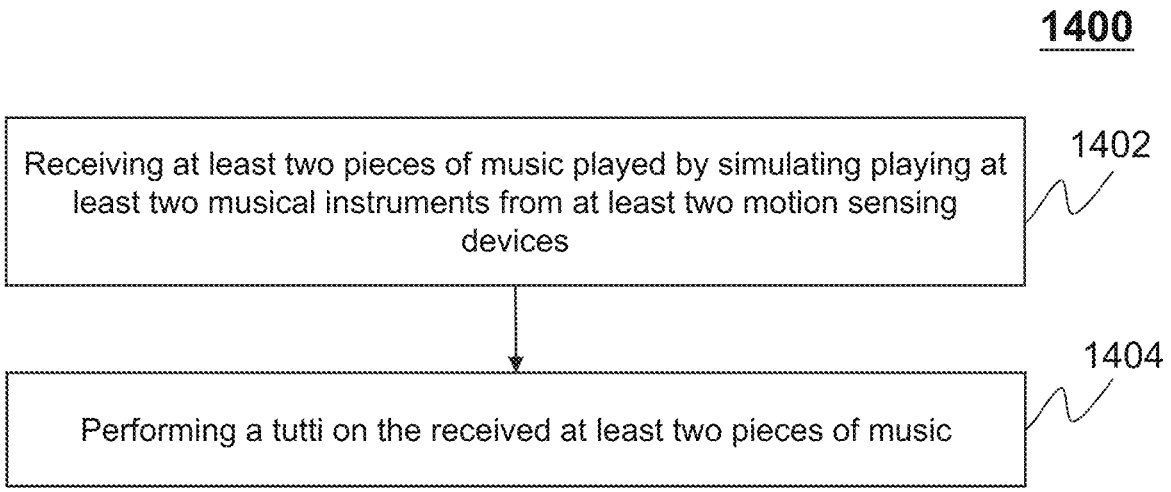
FIG. 14 is a flowchart illustrating a process for music simulation via motion sensing according to some embodiments of the present disclosure.

FIG. 14 is a flowchart illustrating a process for music simulation via motion sensing according to some embodiments of the present disclosure. In some embodiments, the process 1400 may be implemented on a musical instrument terminal. The musical instrument terminal may include at least one processor and at least one storage device. In some embodiments, the process 1400 may be implemented in the system 100. For example, the process 1400 may be stored in the storage device 150 and/or the storage (e.g., the ROM 230, the RAM 240, etc.) as a form of instructions, and invoked and/or executed by the server 120, the terminal 140, and/or the motion sensing device(s) 110 (e.g., the processing engine 122 in the server 120, or the processor 210 of the computing device 200).

In 1402, the musical instrument terminal may receive at least two pieces of music played by simulating at least two musical instruments from at least two motion sensing devices.

In 1404, the musical instrument terminal may perform a tutti on the received at least two pieces of music.

The motion sensing device (e.g., the transmitting module 430) may determine the at least two pieces of music played by simulating the at least two musical instruments and transmit the at least two pieces of music to the musical instrument terminal. The musical instrument terminal may include but not limited to a smart musical instrument, such as a smart piano. The musical instrument terminal may perform the tutti based on the at least two pieces of music. In some embodiments, a plurality of users may play the music via the plurality of motion sensing devices according to a plurality of sub-scores that belong to a same music score. The tutti may be played by a same musical instrument terminal or a plurality of musical instrument terminals.

It should be noted that the above description is merely provided for the purposes of illustration, and not intended to limit the scope of the present disclosure. For persons having ordinary skills in the art, multiple variations and modifications may be made under the teachings of the present disclosure. However, those variations and modifications do not depart from the scope of the present disclosure.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure and are within the spirit and scope of the embodiments of this disclosure.

Moreover, certain terminology has been used to describe embodiments of the present disclosure. For example, the terms "one embodiment," "an embodiment," and "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "module," "unit," "component," "device," or "system." Furthermore, aspects of the present disclosure may take the form of a computer program product embodied in one or more computer readable media having computer readable program code embodied thereon.

A computer readable signal medium may include a propagated data signal with computer readable program code embodied therein, for example, in baseband or as part of a carrier wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB. NET, Python or the like, conventional procedural programming languages, such as the "C" programming language, Visual Basic, Fortran 2003, Perl, COBOL 2002, PHP, ABAP, dynamic programming languages such as Python, Ruby, and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claim subject matter lie in less than all features of a single foregoing disclosed embodiment.

What is claimed is:

1. A system for music simulation, comprising:

at least one storage device storing a set of instructions;

at least one sensor configured to obtain data associated with one or more simulation actions of a user simulating playing a specific musical instrument;

at least one processor in communication with the at least one storage device, wherein when executing the set of instructions, the at least one processor is directed to cause the system to:

determine the one or more simulation actions based on the data associated with the one or more simulation actions acquired by the at least one sensor;

determine, based on at least one of the one or more simulation actions and a mapping relationship between simulation actions and corresponding musical instruments, a simulation musical instrument that matches with the one or more simulation actions;

determine, based on the one or more simulation actions, one or more first features associated with the simulation musical instrument, wherein to determine the one or more first features, the at least one processor is further directed to cause the system to:

determine one or more second features associated with the one or more simulation actions; and determine, based on the one or more second features, the one or more first features; and play music using the simulation musical instrument based on the one or more first features.

2. The system of claim 1, wherein the at least one sensor includes at least one of a camera or an accelerometer.

3. The system of claim 1, wherein the data includes movement data generated by the user moving the at least one sensor, and to determine the one or more simulation actions based on the data, the at least one processor is directed to cause the system to:

determine, based on the movement data of the user, a displacement of the at least one sensor; and determine, based on the displacement of the at least one sensor, the one or more simulation actions.

4. The system of claim 1, wherein the data includes image data of the user moving the at least one sensor, and to determine the one or more simulation actions based on the data, the at least one processor is directed to cause the system to:

identify the one or more simulation actions from the image data of the user.

5. The system of claim 1, wherein the one or more first features include at least one of a pronunciation intensity of the simulation musical instrument, a music rhythm of the simulation musical instrument, or a pitch of the simulation musical instrument.

6. The system of claim 5, wherein the one or more second features include at least one of one or more amplitudes of the one or more simulation actions or a rhythm of the one or more simulation actions.

7. The system of claim 6, wherein to determine, based on the one or more second features, the one or more first features, the at least one processor is directed to cause the system to:

determine the one or more pronunciation intensities of the simulation musical instrument based on the one or more amplitudes of the one or more simulation actions; and determine the music rhythm of the simulation musical instrument based on the rhythm of the one or more simulation actions.

8. The system of claim 1, wherein the at least one processor is further directed to cause the system to:

perform a tutti on at least two pieces of music associated with at least two of the simulation musical instruments.

9. A method for music simulation, implemented on a computing device having at least one processor and at least one non-transitory storage medium, the method comprising:

acquiring data associated with one or more simulation actions of a user simulating playing a specific musical instrument from at least one sensor;

determining the one or more simulation actions based on the data associated with the one or more simulation actions;

determining, based on at least one of the one or more simulation actions and a mapping relationship between simulation actions and corresponding musical instruments, a simulation musical instrument that matches with the one or more simulation actions;

determining, based on the one or more simulation actions, one or more first features associated with the simulation musical instrument, wherein the determining the one or more first features, the method further comprises:

determining one or more second features associated with the one or more simulation actions; and determining, based on the one or more second features, the one or more first features; and playing music using the simulation musical instrument based on the one or more first features.

10. The method of claim 9, wherein the at least one sensor includes at least one of a camera or an accelerometer.

11. The method of claim 9, wherein the data includes movement data generated by the user moving the at least one sensor, and the determining one or more simulation actions based on data associated with one or more simulation actions acquired by at least one sensor includes:

determining, based on the movement data of the user, a displacement of the at least one sensor; and determining, based on the displacement of the at least one sensor, the one or more simulation actions.

12. The method of claim 9, wherein the data includes image data of the user moving the at least one sensor, and the determining one or more simulation actions based on data associated with one or more simulation actions acquired by at least one sensor includes:

identifying the one or more simulation actions from the image data of the user.

13. The method of claim 9, wherein the one or more first features include at least one of a pronunciation intensity of the simulation musical instrument, a music rhythm of the simulation musical instrument, or a pitch of the simulation musical instrument.

14. The method of claim 13, wherein the one or more second features include at least one of one or more amplitudes of the one or more simulation actions or a rhythm of the one or more simulation actions.

15. The method of claim 14, wherein the determining the one or more first features include:

determining the one or more pronunciation intensities of the simulation musical instrument based on the one or more amplitudes of the one or more simulation actions; and determining the music rhythm of the simulation musical instrument based on the rhythm of the one or more simulation actions.

16. The method of claim 9, further comprising:

performing a tutti on at least two pieces of music associated with at least two of the simulation musical instruments.

17. A non-transitory computer readable medium, comprising a set of instructions for music simulation, wherein when executed by at least one processor, the set of instructions direct the at least one processor to effectuate a method, the method comprising:

acquiring data associated with one or more simulation actions of a user simulating playing a specific musical instrument from at least one sensor;

determining the one or more simulation actions based on the data associated with the one or more simulation actions;

determining, based on at least one of the one or more simulation actions and a mapping relationship between simulation actions and corresponding musical instruments, a simulation musical instrument that matches with the one or more simulation actions;

determining, based on the one or more simulation actions, one or more first features associated with the simulation musical instrument, wherein the determining the one or more first features, the method further comprises:

determining one or more second features associated with the one or more simulation actions; and determining, based on the one or more second features, the one or more first features; and playing music based on the one or more first features.

* * * * *